US010935297B2

(12) United States Patent
Palese et al.

(10) Patent No.: US 10,935,297 B2
(45) Date of Patent: Mar. 2, 2021

(54) GRINDER HEAD COOLER

(71) Applicant: Blue Sky Innovation Group, Inc., Avon, OH (US)

(72) Inventors: Jeffrey W. Palese, North Ridgeville, OH (US); Gregg M. Kloeppel, Sheffield Lake, OH (US)

(73) Assignee: BLUE SKY INNOVATION GROUP, INC., Avon, OH (US)

( * ) Notice: Subject to any disclaimer, the term of this patent is extended or adjusted under 35 U.S.C. 154(b) by 171 days.

(21) Appl. No.: 16/125,934

(22) Filed: Sep. 10, 2018

(65) Prior Publication Data

US 2019/0056163 A1 Feb. 21, 2019

Related U.S. Application Data

(63) Continuation-in-part of application No. 14/686,448, filed on Apr. 14, 2015, now abandoned.

(60) Provisional application No. 61/979,212, filed on Apr. 14, 2014.

(51) Int. Cl.
*F25D 3/02* (2006.01)
*B02C 18/30* (2006.01)

(52) U.S. Cl.
CPC ..... *F25D 3/02* (2013.01); *B02C 18/301* (2013.01); *B02C 18/304* (2013.01); *B02C 18/305* (2013.01); *B02C 2018/307* (2013.01); *F25D 2303/08221* (2013.01); *F25D 2303/08222* (2013.01)

(58) Field of Classification Search
CPC .... F25D 3/02; F25D 2303/08221; F25D 3/08; F25D 2303/082; F25D 2303/0841; F25D 2303/0846; B02C 18/301; B02C 18/304; B02C 18/305
See application file for complete search history.

(56) References Cited

U.S. PATENT DOCUMENTS 1,942,083 A * 1/1934 Biancalana ..... B02C 18/302 165/77
3,217,793 A * 11/1965 Coe ..... H01L 23/4006 165/80.3
3,436,948 A * 4/1969 Portal ..... E02F 3/405 72/370.04
4,187,711 A * 2/1980 Lavochkin ..... B21C 23/14 72/256
4,281,520 A * 8/1981 Norwood ..... F25D 3/08 62/372
5,192,039 A * 3/1993 Williams ..... F16L 59/135 138/107

FOREIGN PATENT DOCUMENTS

CA 2735116 A1 * 9/2011 ..... B02C 18/302

* cited by examiner

*Primary Examiner* — Kun Kai Ma
(74) *Attorney, Agent, or Firm* — Tarolli, Sundheim, Covell & Tummino LLP

(57) ABSTRACT

An apparatus for cooling a food processing grinder head with an integrated heatsink is captively retained between two halves of a cooling pack. The heatsink and cooling pack have a circumference that matches the circumference of the grinder head thereby attaching to and in direct thermal communication with the grinder head.

10 Claims, 30 Drawing Sheets

GRINDER HEAD COOLER

RELATED APPLICATION

This application is a continuation-in-part of U.S. patent application Ser. No. 14/686,448, filed on Apr. 14, 2015, which is a non-provisional application based on U.S. Provisional Application No. 61/979,212, filed Apr. 14, 2014. The disclosures of these applications are hereby incorporated by reference in their entireties.

TECHNICAL FIELD

This invention relates to a food processing apparatus. More specifically, this invention relates to a grinder head cooler adapted to receive a coolant that helps maintain the grinder head in a cooled condition during use.

BACKGROUND OF THE INVENTION

Grinders are food processing and preparation appliances used to grind, chop or mince a variety of foods such as meats, vegetables or fruits. As the density of the food increases such as with meats, during this grinding operation the friction caused by grinding increases the temperature of the grinder head and meat. This temperature rise can be high enough to be conducive to bacteria growth and spoilage during this grinding process. Cooling the grinding head with frozen packs cools the head and meat but does not allow a means for the heat of grinding to escape. As the cooling packs melt the performance of the cooling packs diminish. By providing an apparatus that can cool and remove heat from the grinder head, the cooling pack performance increases by the reduced temperature of the grinder head and extended duration of the frozen packs. This in turn will provide increased food safety reducing the likelihood of spoilage and improve the grinding performance by reducing the adhesion of the ground food to the grinder head.

SUMMARY OF THE INVENTION

According to one aspect, an apparatus for grinding food products includes a housing including an inlet for receiving food products to be ground, an outlet for discharging the ground food product, and a grinding portion for housing components operable to grind the food product. The apparatus also includes a cooling pack adapted to be connected to an outside surface of the housing to cool the grinding portion.

According to another aspect, the grinding portion has a generally cylindrical outside configuration that the cooling pack is configured to follow.

According to another aspect, the housing includes one or more tabs, and the cooling pack comprises one or more slots for receiving the tabs to thereby connect the cooling pack to the housing.

According to another aspect, the cooling pack extends circumferentially about 180 degrees around the grinding portion.

According to another aspect, an apparatus for cooling a grinder head includes a cooling pack adapted to be connected to an outer surface of a housing of the grinder head to cool the grinder head housing.

According to another aspect, the cooling pack can have a cylindrical configuration that mates with the cylindrical outer surface of the grinder head housing.

According to another aspect, the cooling pack can extend circumferentially greater than 180 degrees around the grinder head housing.

According to another aspect, the cooling pack can have a freezable and re-freezable construction.

According to another aspect, the cooling pack can include a first cooling pack half that has a cylindrical inner surface, and a second cooling pack half that has a cylindrical inner surface, the first and second cooling packs being connected to each other.

According to another aspect, the apparatus can include a first strap that connects a first end of the first cooling pack half to a first end of the second cooling pack half, the first strap being constructed and arranged to permit the first and second cooling pack halves to move relative to each other. The apparatus can also include a second strap that connects a second end of the first cooling pack half to a second end of the second cooling pack half, the second strap being releasable connectable with at least one of the first and second cooling pack halves.

According to another aspect, the first strap can permit the first and second cooling pack halves to move to an open condition in which the grinder head housing can be positioned between the halves, and wherein the second strap when connected to both cooling pack halves draws the halves together to connect the cooling pack to the grinder head housing.

According to another aspect, at least one of the first and second straps can have an elastomeric construction that applies a force to the cooling pack halves that draws the halves into mating engagement with the outer surface of the grinder head housing.

According to another aspect, at least one of the first and second straps can connect with at least one of the first and second cooling pack halves via an opening in the strap that deforms elastically to receive a tab on the cooling pack, the opening forming an interference with the tab that connects the strap to the cooling pack half.

According to another aspect, the first and second cooling pack halves can include gel-filled cooling packs.

According to another aspect, a grinder head housing cooling apparatus includes first and second cooling pack halves filled with a freezable and re-freezable substance, and at least one connector for connecting the cooling pack halves to each other and to the outer surface of the grinder head housing to cool the grinder head housing through thermal heat transfer.

According to another aspect, each of the cooling pack halves can have a cylindrical configuration that mates with the cylindrical outer surface of the grinder head housing.

According to another aspect, each cooling pack half can extend circumferentially less than 180 degrees around the grinder head housing, and wherein the cooling pack halves together extend circumferentially greater than 180 degrees around the grinder head housing.

According to another aspect, the first cooling pack half can have a cylindrical inner surface, and the second cooling pack half has a cylindrical inner surface.

According to another aspect, the apparatus can also include a first strap that connects a first end of the first cooling pack half to a first end of the second cooling pack half, the first strap being constructed and arranged to permit the first and second cooling pack halves to move relative to each other. The apparatus can also include a second strap that connects a second end of the first cooling pack half to a second end of the second cooling pack half, the second strap being releasable connectable with at least one of the first and second cooling pack halves.

According to another aspect, the first strap can permit the first and second cooling pack halves to move to an open condition in which the grinder head housing can be positioned between the halves, and wherein the second strap when connected to both cooling pack halves draws the halves together to connect the cooling pack to the grinder head housing.

According to another aspect, at least one of the first and second straps can have an elastomeric construction that applies a force to the cooling pack halves that draws the halves into mating engagement with the outer surface of the grinder head housing.

According to another aspect, at least one of the first and second straps can connect with at least one of the first and second cooling pack halves via an opening in the strap that deforms elastically to receive a tab on the cooling pack, the opening forming an interference with the tab that connects the strap to the cooling pack half.

According to another aspect, the first and second cooling pack halves can include gel-filled cooling packs.

According to another aspect, a cooling pack can be attached circumferentially to the outer surface of a grinder head of a grinder appliance. Food is placed in a food tray attached to a cylindrical entry port on the grinder head. Food is pushed in to this entry port of the grinder head, an electric motor turns an auger internally in the grinder head grinding the food. The heat generated by this grinding operation needs to be controlled to prevent spoilage of the food.

According to this aspect, the circumferentially wrapped cooling pack includes a heatsink retained between two cooling pack halves. The heatsink transfers heat from the grinder head to ambient air. The cooling pack and the heatsink have circumferences that matches the circumference of the outer surface of the grinding head. Both the cooling pack and the heatsink thereby are in direct thermal contact with the grinder head. The cooling packs cool the grinder head by the physical phase change process of ice to water. These cooling packs, however, do not have a means to distribute the heat of the grinder head to ambient air. The heatsink provides a thermal conduit path through the cooling pack enclosure transporting heat from the grinder head to be dispersed to ambient air. The heatsink improves the cooling performance for cooling the grinder head by conducting the thermally generated heat of the grinder head to ambient air thereby reducing the heat load of the grinder head and allowing the cool packs a slower rate of phase change due to the reduced temperature gradient of the grinder head to the cool pack surface.

BRIEF DESCRIPTION OF THE DRAWINGS

For a better understanding of the invention, reference may be made to the accompanying drawings.

DESCRIPTION OF EMBODIMENTS

Figure 1:
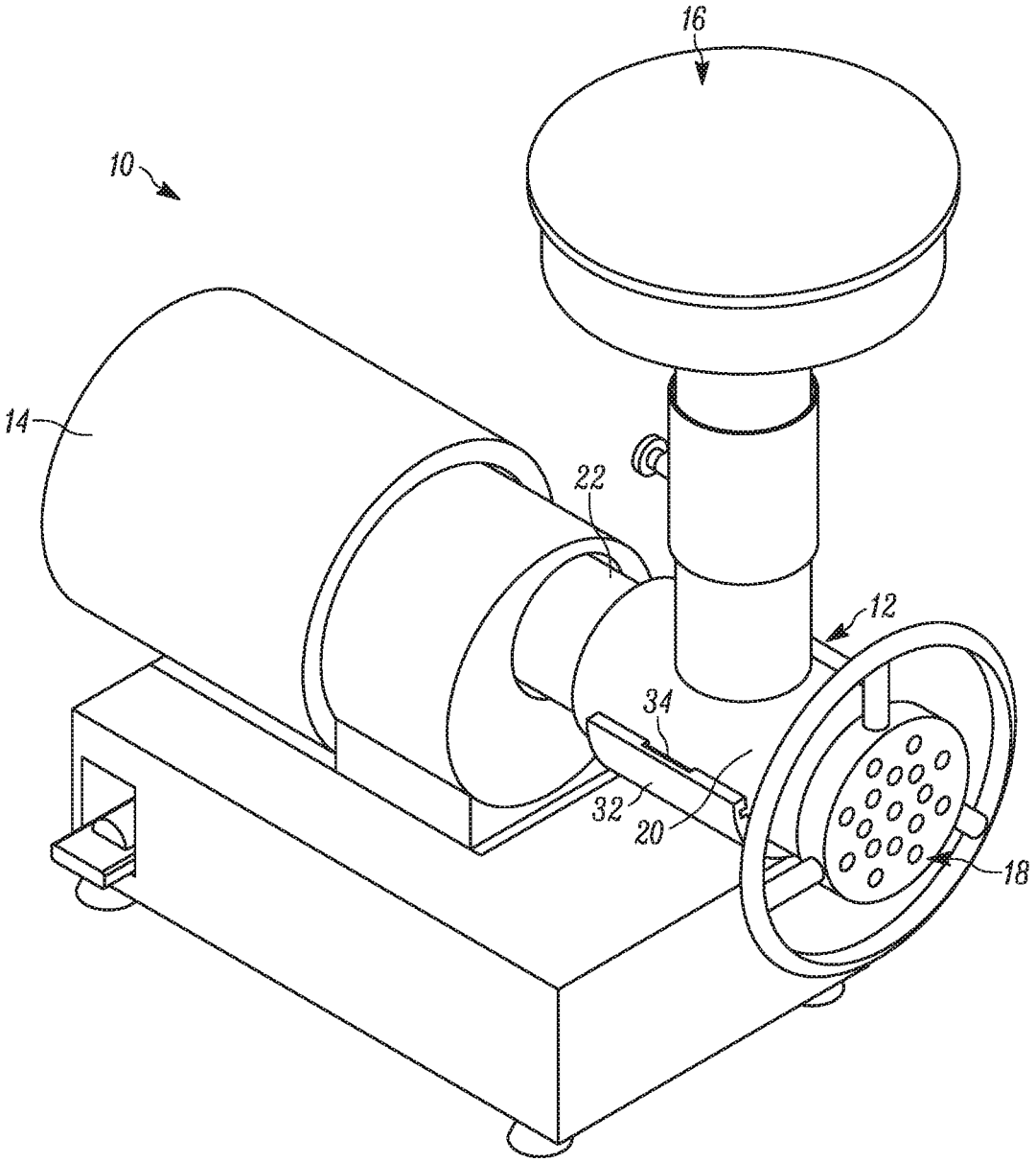
FIG. 1 is a perspective view illustrating a grinder including a grinder head according to an embodiment of the invention.
Figure 2:
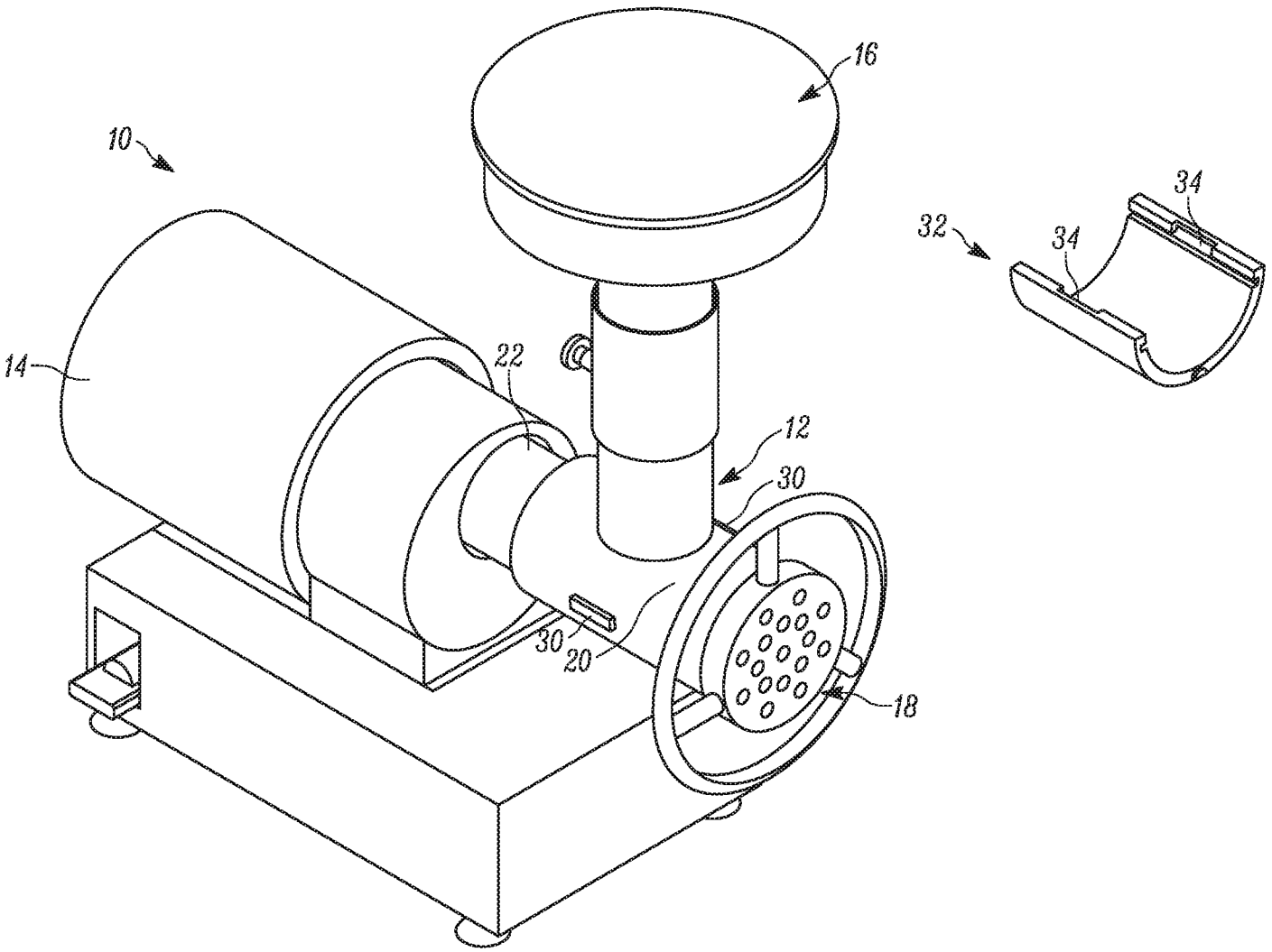
FIG. 2 is a partially exploded perspective view of the grinder of FIG. 1.

A known food processing apparatus 10 in the form of a meat grinder is illustrated in FIGS. 1 and 2. The meat grinder 10 includes a grinder head 12 and a power source 14, such as an electric motor. The electric motor power source could be replaced with a hand crank. The grinder head 12 includes an inlet or chute 16, into which raw meat is fed, and an outlet 18 from which the ground or minced meat is discharged. The grinder head 12 includes a housing 20 that houses typical grinder components, such as an auger/screw conveyor, a rotating knife including mincing blades, and a fixed hole plate or die. These typical components are shown, for example, in U.S. Pat. No. 7,207,510 B2, issued Apr. 24, 2007, the disclosure of which is hereby incorporated by reference in its entirety. A collar 22 attaches to the housing 20 to contain the grinder components therein. The collar 22 is removable from the housing for cleaning and for replacing/swapping components.

Whole or cubed raw meat is fed into the inlet 16 on top of the grinder head, and the meat is propelled horizontally on the rotating screw conveyor, which can also squash and partially mix the meat as it is propelled. At the end of the screw conveyor, the knife is positioned in front of and adjacent to the fixed hole plate. The screw conveyor forces the meat past the knife and through the plate. The rotating knife blades mince or grind the meat, which is discharged through the holes in the plate and through the outlet 18. The size of the holes in the plate determines the fineness of the ground meat.

According to a first embodiment of the invention, the meat grinder 10 includes a cooling feature that counteracts heating due to friction between internal components. This helps prevent the meat from heating up as it is ground, which can cause the ground meat to stick to the grinder components and inhibit or halt the grinding process. The cooling feature can have a variety of configurations.

In the illustrated embodiment, the housing 20 includes a pair of tabs 30 that serve to support a cooling pack 32. The cooling pack 32 has a generally semi-cylindrical configuration that mates with a lower portion of the grinder housing 20. The cooling pack 32 includes a pair of slots 34 that are spaced and configured to receive the tabs 30. The tabs 30 cooperate with the slots 34 to support the cooling pack 32 on the housing 20. In the illustrated embodiment, the cooling pack 32 extends circumferentially around about half of, i.e., about 180 degrees around, the housing 20. The extent to which the cooling pack 32 extends circumferentially around the housing 20 can vary.

The cooling pack 32 can be filled with a coolant, such a liquid/gel-type substance commonly found in freezer chilled cooling packs. These gel in the gel packs are primarily water-based and include a gel-forming substance, such as hydroxyethyl cellulose or a vinyl-coated silica gel. Other materials can be added to prevent bacterial growth. Advantageously, the substance in such gel packs can formulated to have a freezing point below that of water (32° F.) and therefore can enhance the cooling of the grinder head 12.

The cooling pack 32 can have a variety of constructions. For example, the cooling pack 32 can be formed of plastic, metal, or a combination of plastic and metal. In one example construction, the cooling pack 32 can have a plastic portion that defies the coolant containing portion of the pack, and a metal portion fixed to the outside of the plastic portion to provide a metallic appearance. The metal portion can also lend strength and durability to the cooling pack 32, especially to the slots 34 that receives the tabs 30. This can be advantageous in that the metal or metal portions of the slots 34 can provide increased durability in comparison with plastic.

Figure 3:
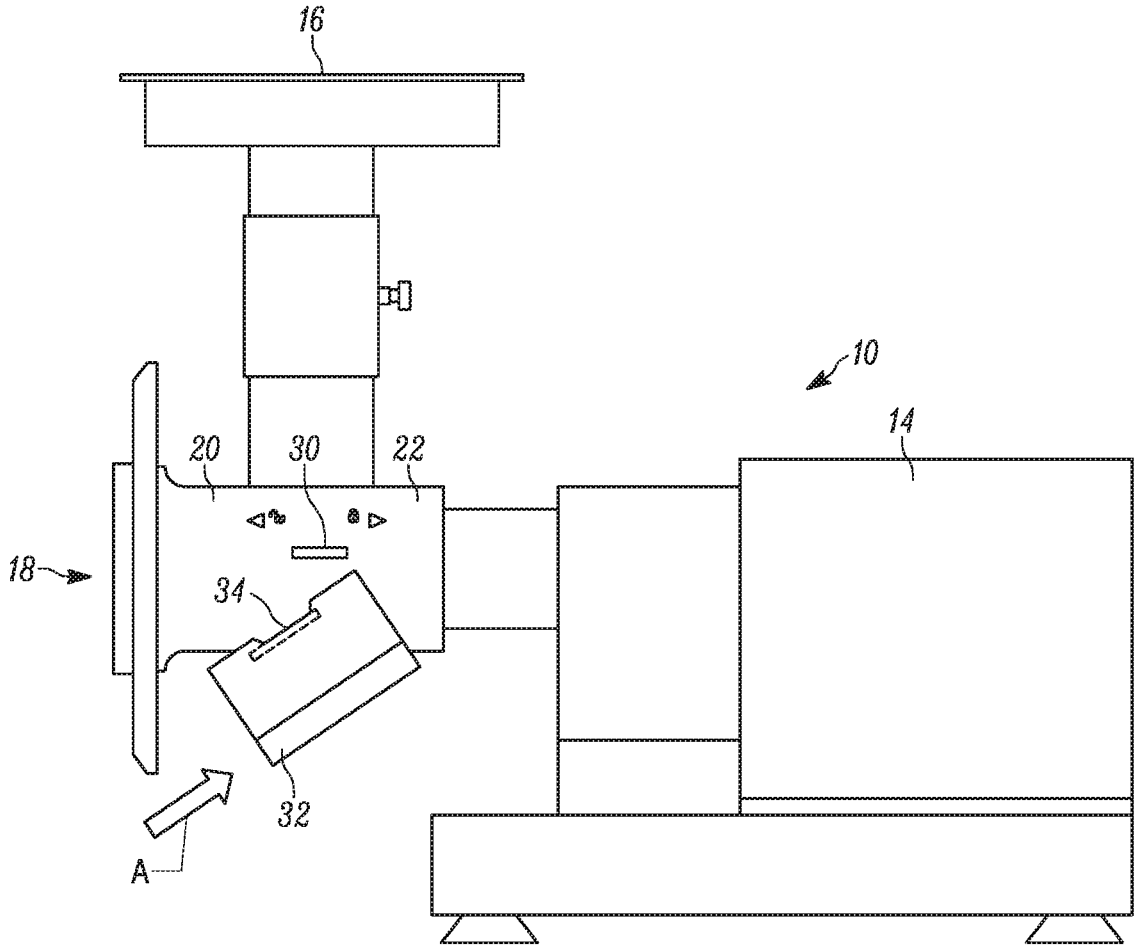
FIG. 3 is a side elevation view illustrating the assembly of a portion of the grinder of FIG. 1.
Figure 4:
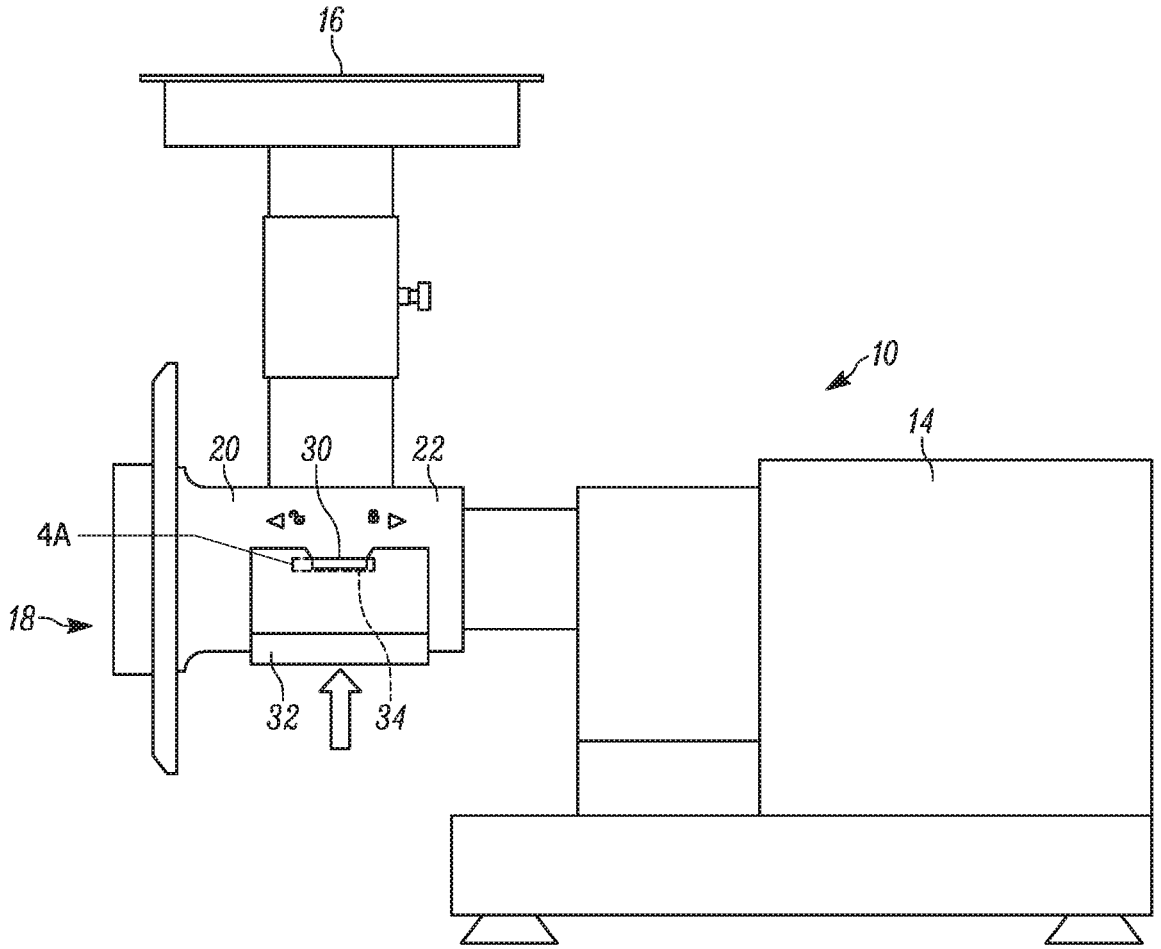
FIGS. 4 and 4A are side elevation views illustrating the assembly of a portion of the grinder of FIG. 1.
Figure 4A:
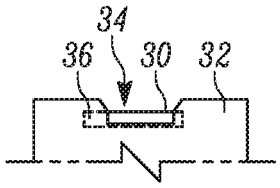
Figure 5:
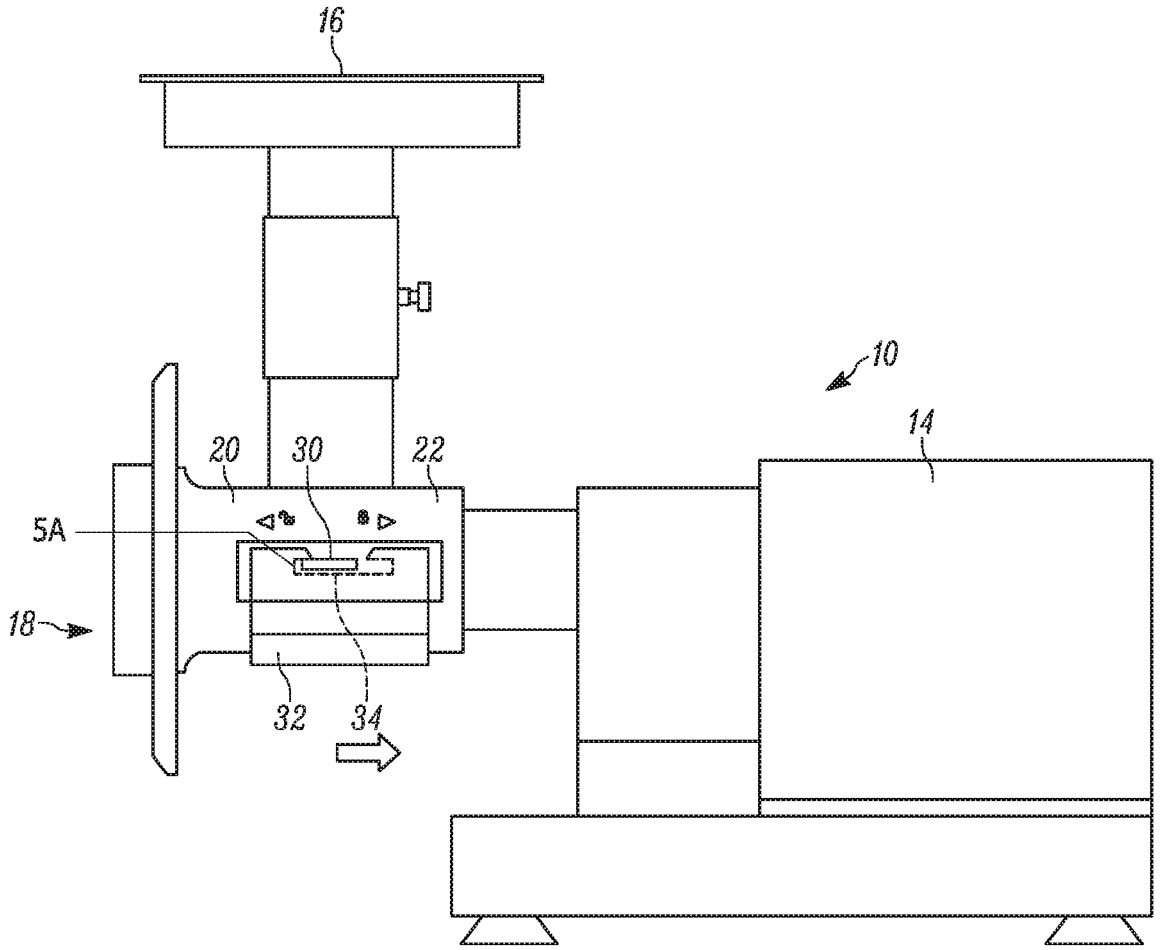
FIGS. 5 and 5A are side elevation views illustrating the assembly of a portion of the grinder of FIG. 1.
Figure 5A:
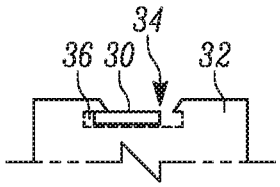
Figure 6:
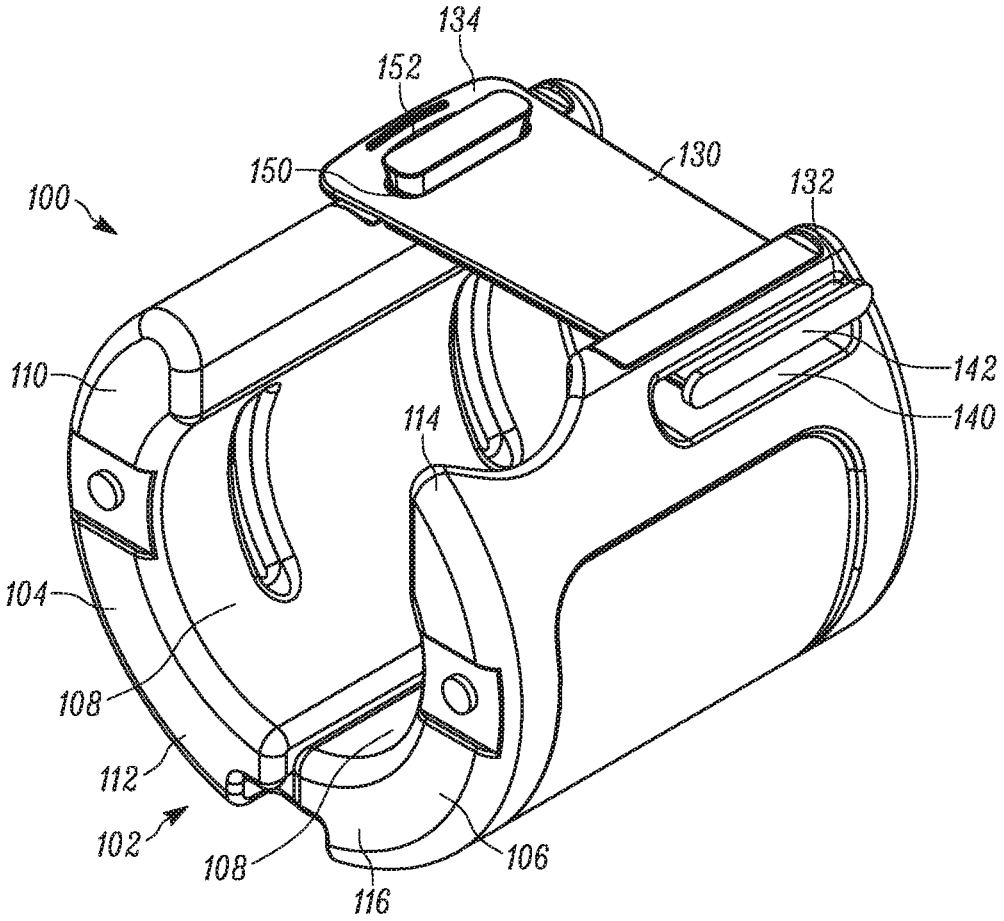
FIG. 6 is a perspective view illustrating an apparatus for cooling a grinder head, according to another embodiment of the invention.
Figure 7:
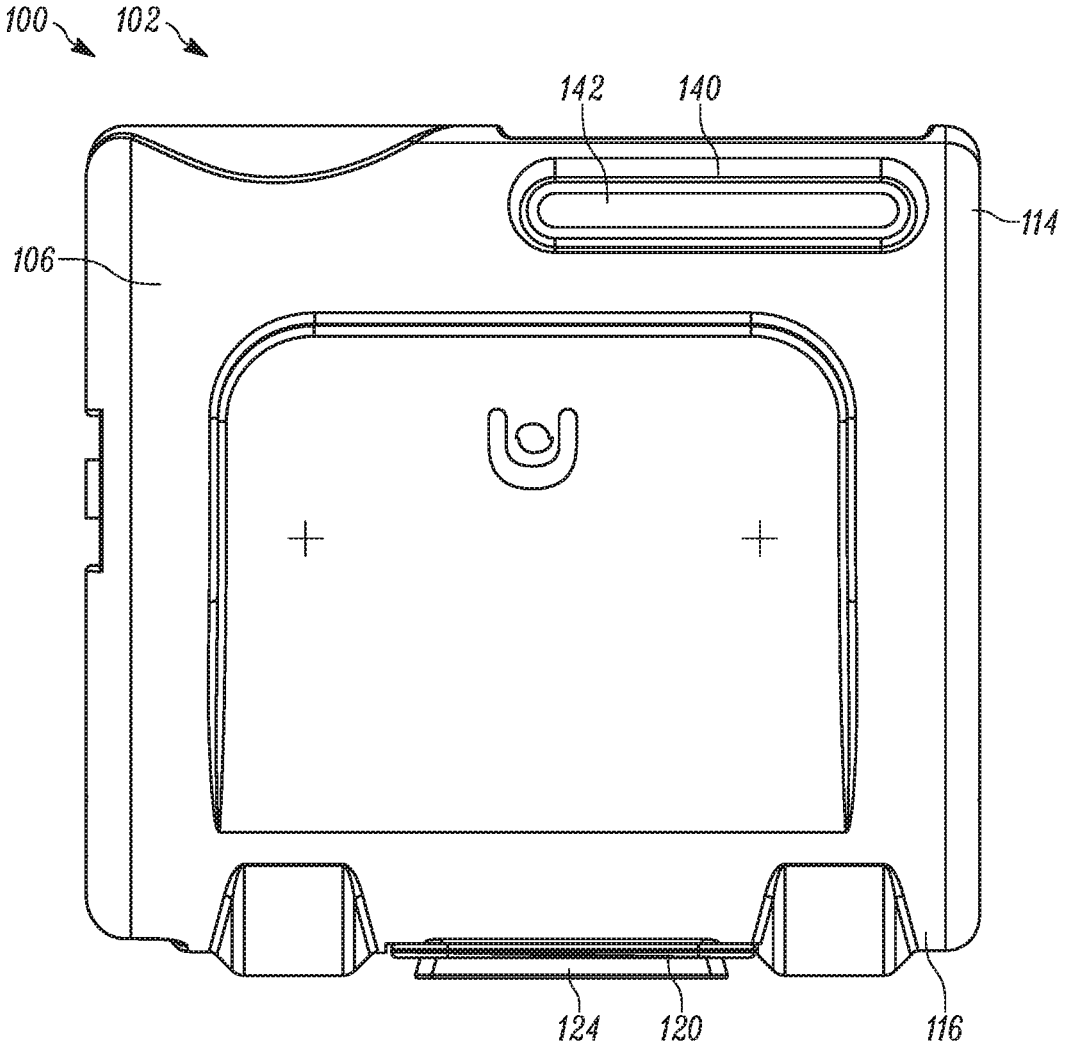
FIG. 7 is a side elevation view of the apparatus of FIG. 6.
Figure 8:
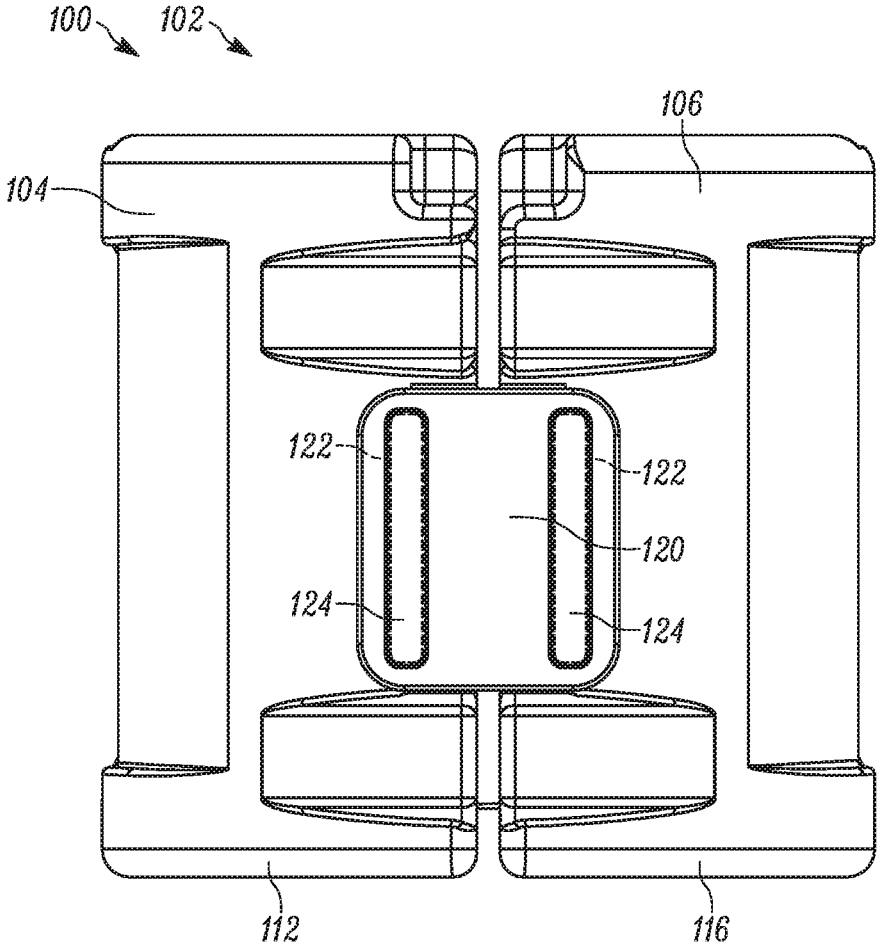
FIG. 8 is a bottom view of the apparatus of FIG. 6.
Figure 9:
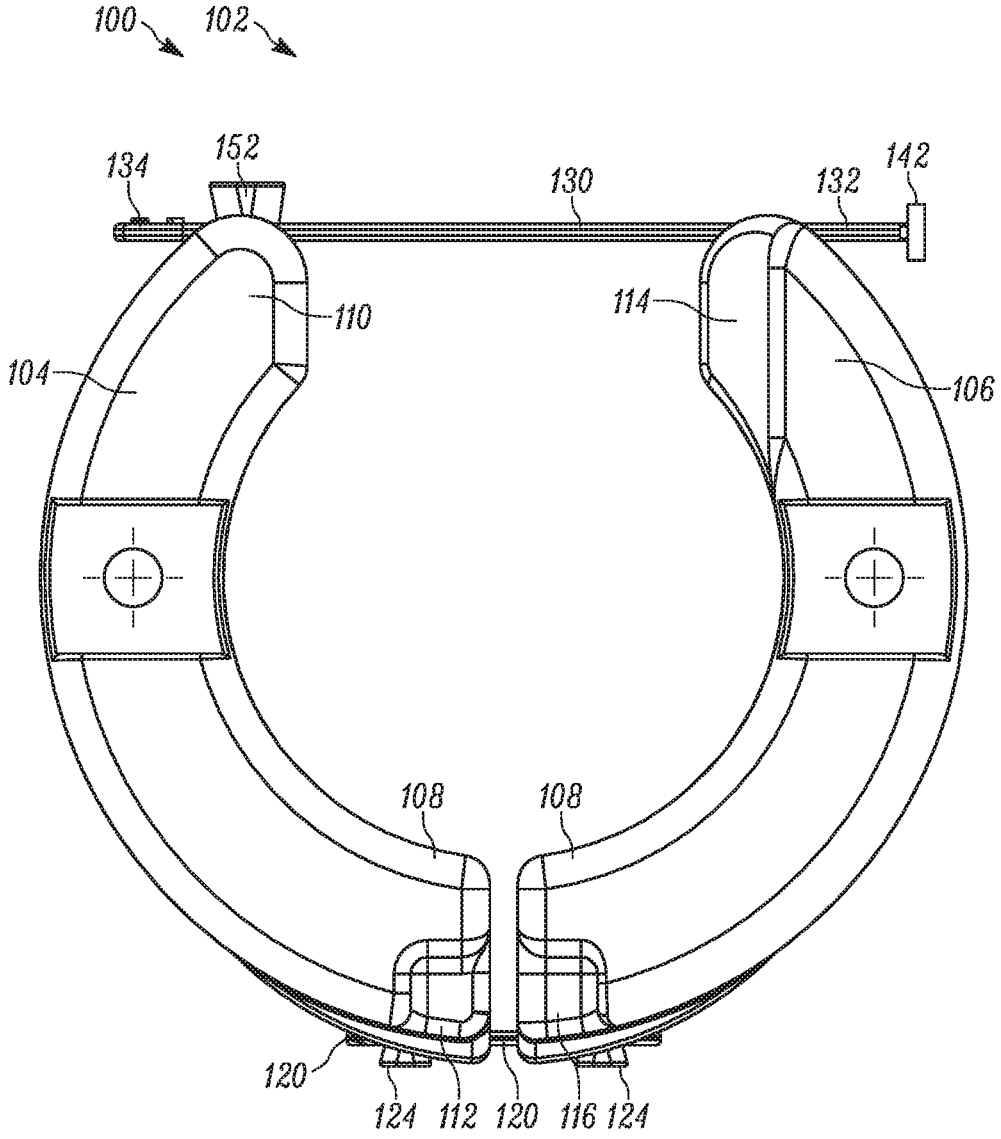
FIG. 9 is a front elevation view of the apparatus of FIG. 6.
Figure 10:
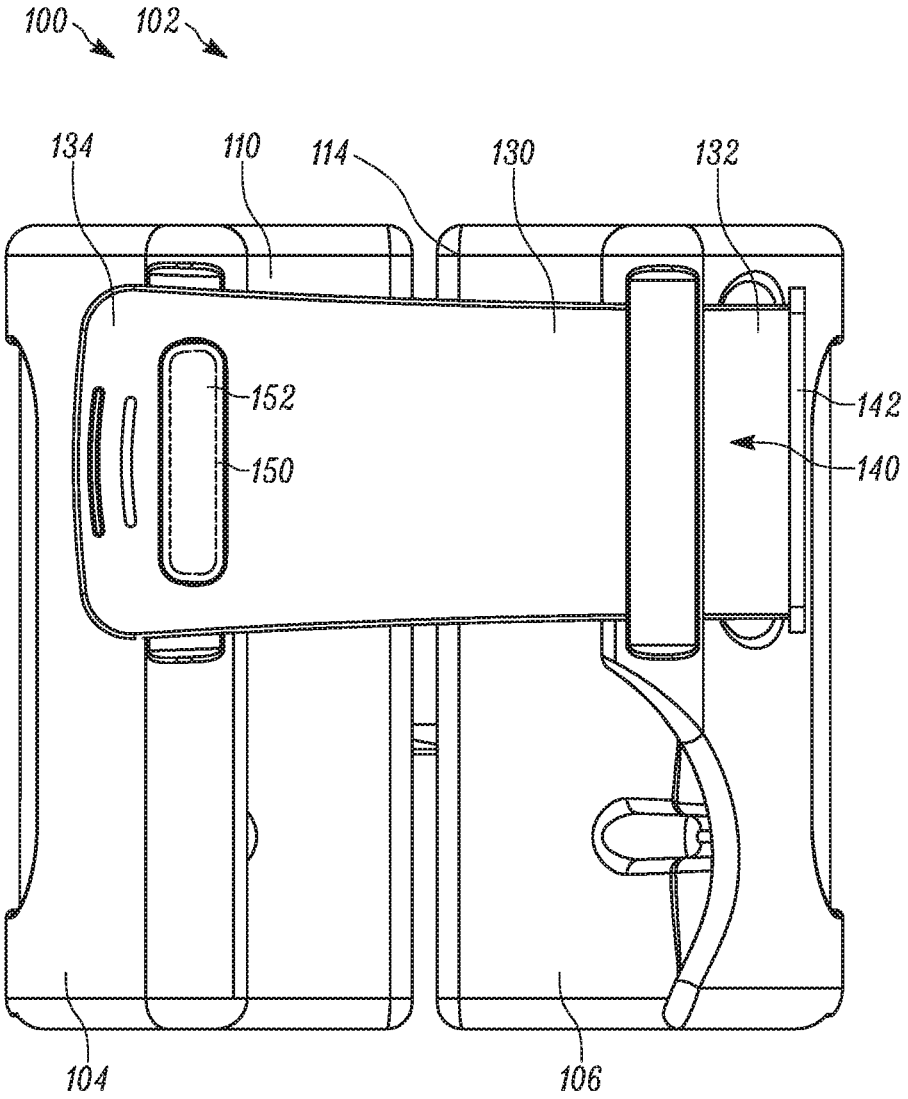
FIG. 10 is a top view of the apparatus of FIG. 6.

Installation of the cooling pack 32 on the grinder head 12 is illustrated in FIGS. 3-5. Referring to FIG. 3, the cooling pack 32 is maneuvered beneath the grinder head 12 so that the concave portion of the pack faces the corresponding portion of the housing 20. The cooling pack 32 is maneuvered in the direction indicated generally by the arrow A in FIG. 3.

Once positioned appropriately relative to the grinder head 12, the cooling pack 32 is maneuvered onto the housing 20, as indicated generally by the arrow B in FIG. 4. When this occurs, the tabs 30 enter their corresponding slots 34 on the cooling pack 32. This can be seen in the detail portion of FIG. 4.

Next, the cooling pack 32 is slid in the direction indicated generally by the arrow C in FIG. 5, so that the tabs 30 enter the closed end 36 of the slot 34. The closed end 36 of the slot 34 retains the cooling pack 32 on the housing 20 of the grinder head 12. This is shown in the detail portion of FIG. 5. To effectuate the retention of the cooling pack 32 on the housing 20, the tabs 30 and the slots 34 may be designed to create an interference fit between the tabs and the closed end 36 of the slots. This fit would help prevent rattling and dislodgement of the cooling pack 32 from the grinder head 12 during use.

Advantageously, the removable cooling pack 32 allows for the use of multiple cooling packs in an interchangeable fashion. When the cooling packs 32 heat up during use and lose their effectiveness, they can be swapped with frozen standby packs, thus eliminating the need to halt the grinding process for a prolonged period.

During use, the cooling packs 32 help to maintain the grinder head 12 at a low temperature. For example, the coolant in the packs 32 can maintain the grinder head 12 at about 40° F. or less. The advantage of a coolant/gel-filled cooling pack 32 is that the gel can be formulated for cooling below 32° F.

A second embodiment is illustrated in FIGS. 6-15. According to the second embodiment, an apparatus 100 adds a cooling feature to a known food processing apparatus 200 in the form of a conventional meat grinder. The meat grinder 200 includes a grinder head 202 and a power source (not shown, see FIGS. 1-5), such as an electric motor. The electric motor power source could be replaced with a hand crank. The grinder head 202 includes an inlet or chute 206, into which raw meat is fed, and an outlet 208 from which the ground or minced meat is discharged. The grinder head 202 includes a housing 210 that houses typical grinder components, such as an auger/screw conveyor, a rotating knife including mincing blades, and a fixed hole plate or die. These typical components are shown, for example, in U.S. Pat. No. 7,207,510 B2, issued Apr. 24, 2007, the disclosure of which is hereby incorporated by reference in its entirety. A collar (not shown, see FIGS. 1-5) attaches to the housing 210 to contain the grinder components therein. The collar is removable from the housing for cleaning and for replacing/swapping components.

Whole or cubed raw meat is fed into the inlet 206 on top of the grinder head, and the meat is propelled horizontally on the rotating screw conveyor, which can also squash and partially mix the meat as it is propelled. At the end of the screw conveyor, the knife is positioned in front of and adjacent to the fixed hole plate. The screw conveyor forces the meat past the knife and through the plate. The rotating knife blades mince or grind the meat, which is discharged through the holes in the plate and through the outlet 208. The size of the holes in the plate determines the fineness of the ground meat.

According to the second embodiment of the invention, the apparatus 100 provides a cooling feature to the meat grinder 200 that counteracts heating due to friction between internal grinder components. This helps prevent the meat from heating up as it is ground, which can cause the ground meat to stick to the grinder components and inhibit or halt the grinding process. The cooling feature can have a variety of configurations.

In the embodiment illustrated in FIGS. 6-15, the apparatus 100 includes a cooling pack 102. The cooling pack 102 has a generally semi-cylindrical, generally C-shaped configuration that mates with a lower portion of the cylindrical grinder housing 210. More specifically, the cooling pack 102 includes first and second halves 104 and 106 that have cylindrical configurations, each of which covers a portion of the housing 210. Each halve 104, 106 has a curved cylindrical inner surface 108 that mates with the outer surface 230 of the grinder housing 210. Each of the cooling pack halves 104, 106 covers less than 180 degrees of the cylindrical outer surface 230 of the housing 210. In combination, the cooling pack halves 104, 106 can cover greater than 180 degrees of the outer surface 230 of the grinder housing 210. For example, the cooling pack halves 104, 106 can be configured so that the cooling pack 102 covers about 300 degrees of the outer surface 230 of the housing 210. The cooling pack 102 could be configured to cover the outer surface 230 to different degrees and extents.

Figure 13:
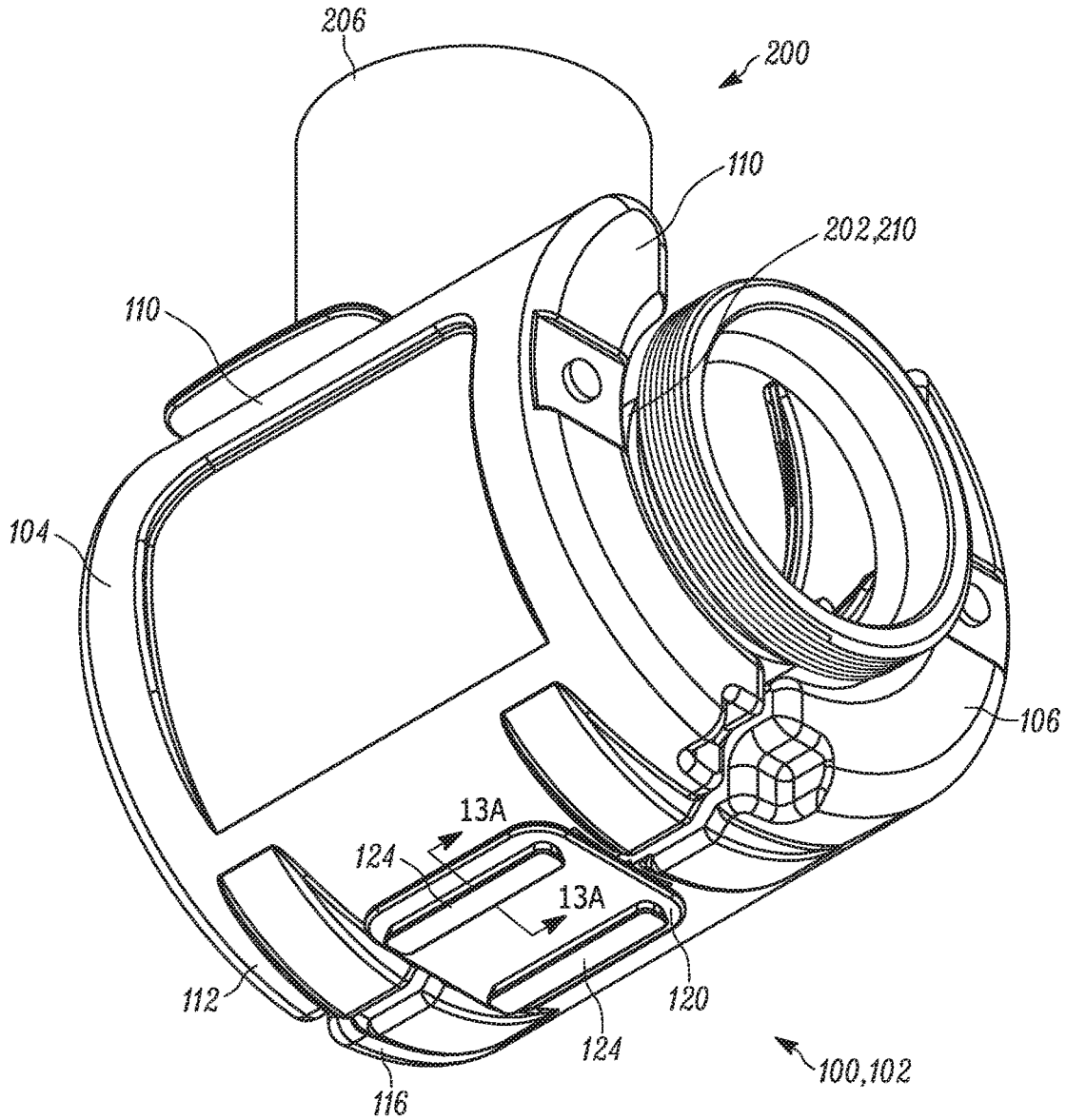
FIG. 13 is a bottom perspective view illustrating the apparatus installed on the grinder head.
Figure 13A:
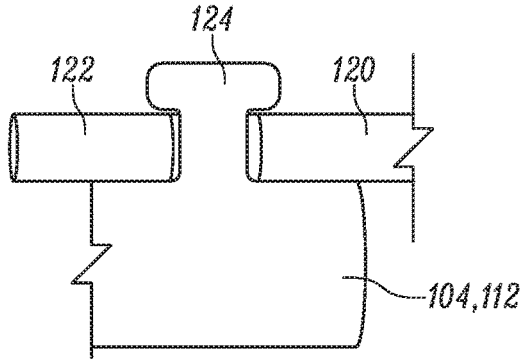
FIG. 13A is a section view taken generally along line 13A-13A in FIG. 13.
Figure 14:
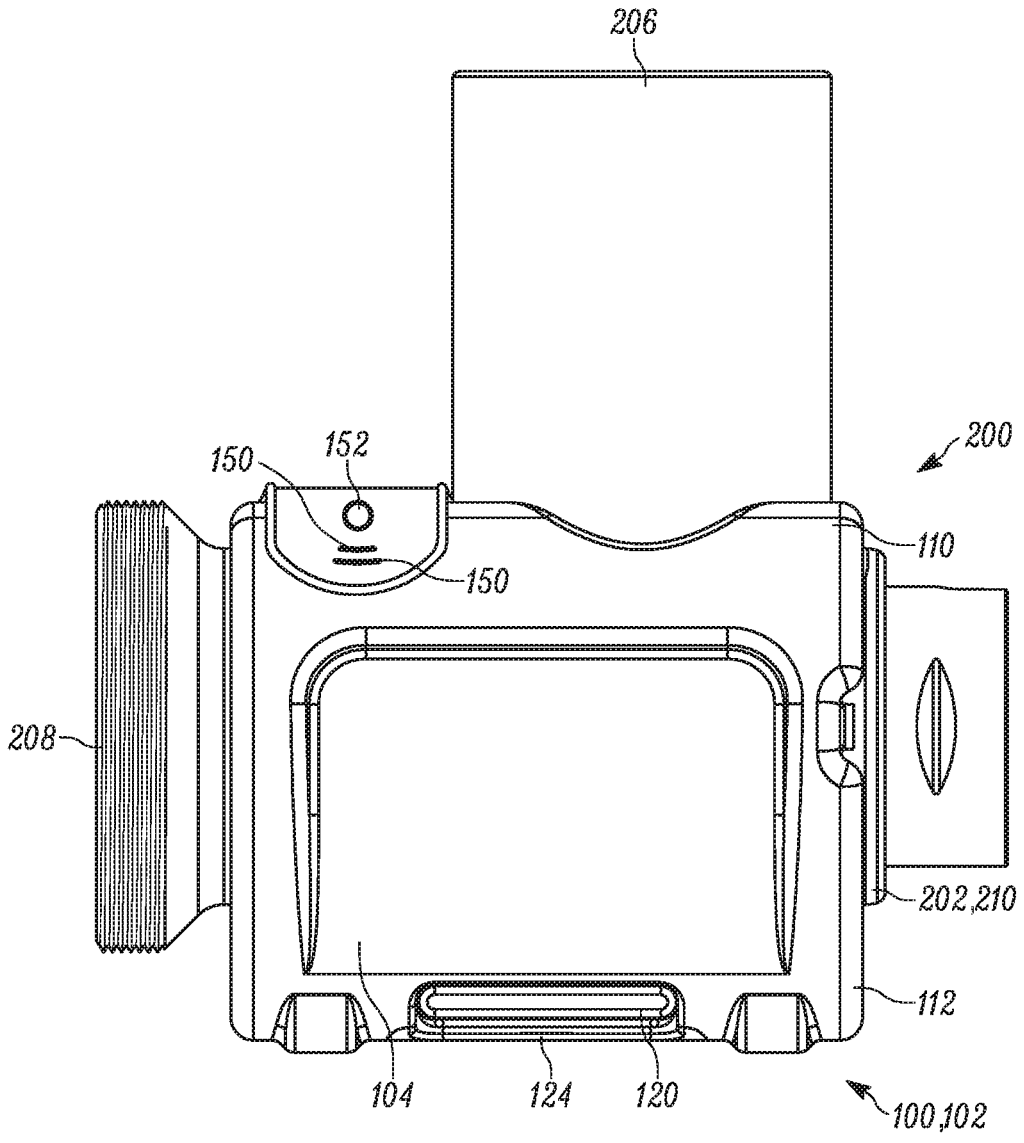
FIG. 14 is a side elevation view of the apparatus of FIGS. 12 and 13.
Figure 15:
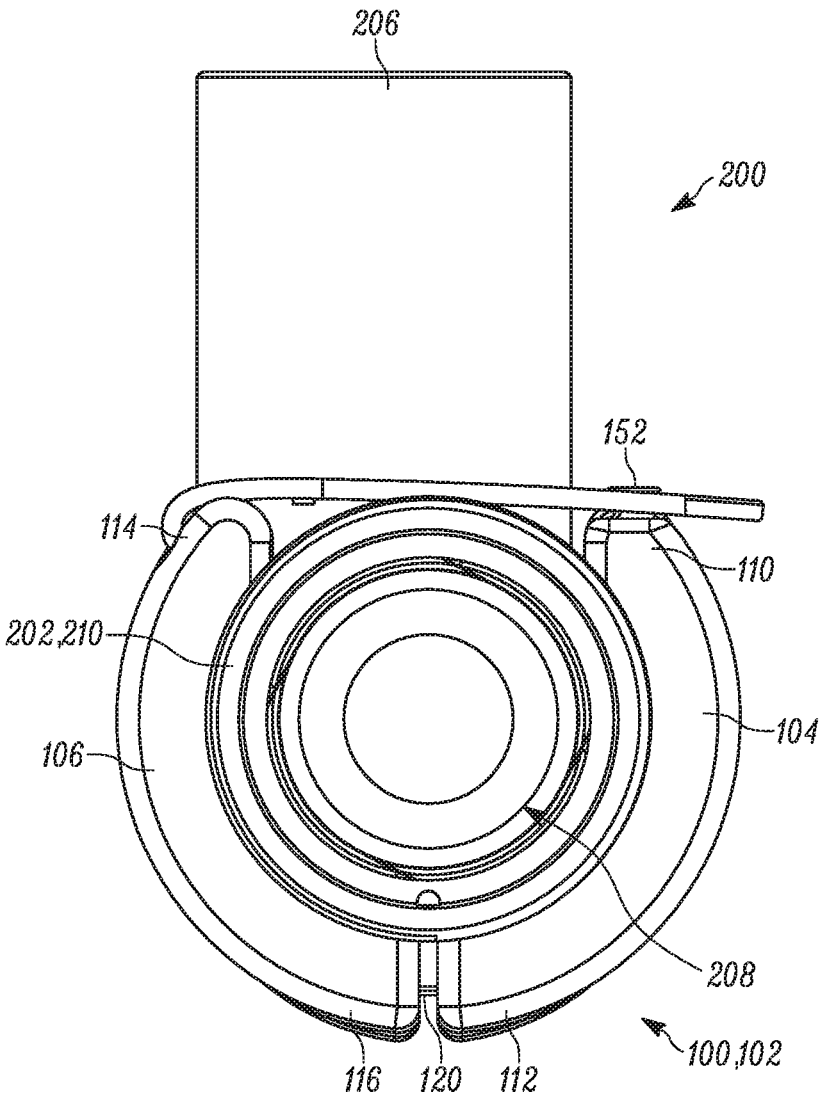
FIG. 15 is a front elevation view of the apparatus of FIGS. 12 and 13.

The first cooling pack half 104 includes a first or upper end 110 and a second or lower end 112. The second cooling pack half 106 includes a first or upper end 114 and a second or lower end 116. The apparatus 100 includes a first strap 120 connects the lower ends 112, 116 of the halves 104, 106 such that the ends are positioned adjacent each other. The first strap 120 can be constructed of an elastomeric material, such as rubber or plastic. In this construction, the first strap 120 includes a pair of elongated openings 122 that mate with respective tabs 124 on each of the lower ends 112, 116. The tabs 124 can be larger than the openings 122 so as to form an interference. The elastomeric first strap 120 can stretch so that the tabs 124 can fit through the openings 122 and will return under their own resilience to their original form to maintain the strap connected to the halves 104, 106 via the interference fit. This is best illustrated in FIG. 13A. The first strap 120 thus can connect the first and second cooling pack halves 104, 106 and also permit the halves to move relative to each other so that the cooling pack 102 can be fit over/around the housing 210.

The lower ends 112, 116 can be connected in alternative manners. For example, the lower ends 112, 116 can be interconnected by a mechanical hinge or by a hinge that is molded integrally with the cooling pack 102. The manner in which the lower ends 112, 116 of the halves 104, 106 are interconnected is not critical as long as the requisite relative movement of the halves is permitted.

The apparatus 100 also includes a second strap 130 that has a first end 132 connected to the upper end 114 of the second half 106 of the cooling pack 102 and an opposite second end 134 that is releasably connectable with the upper end 110 of the first half 104 of the cooling pack 102. The second strap 130 can be constructed of an elastomeric material, such as rubber or plastic. The connections between the second strap 130 and the cooling pack 102 can have any configuration that permits the pack to be fastened to the housing 210 and released from the housing.

In the embodiment illustrated in FIGS. 6-15, the upper end 114 of the second half 106 of the cooling pack 102 includes an elongated opening 140 through which the first end 132 of the second strap 130 can be passed through. The second strap 130 can be drawn through the opening 140 until the second end 134 reaches the opening. At that point, an elongated, transversely extending stop piece 142 at the second end 134 of the strap 130 enters the opening 140 and forms an interference with the second half 106 of the cooling pack 102 and thereby connects the second strap 130 to the second half.

The second end 134 of the second strap 130 includes one or more elongated openings 150 that are connectable with a tab 152 on the upper end 110 of the first half 104 of the cooling pack 102. The tab 152 and opening 150 can cooperate to connect the second end 134 of the second strap 130 to the first half 104 in a manner similar or identical to that shown in FIG. 13A. The second strap 130 can thus be connected to the first half 104 and disconnected from the second half with ease and repeatability.

The connections of the second strap 130 can have alternative configurations. For example, the first end 132 of the strap 130 can be connected to the second half 106 via a mechanical fastener, such as a rivet. The second end 134 of the strap 130 can be connected to the first half 104 via a mechanical fastener, such as a buckle.

The cooling pack 102, i.e., the cooling pack halves 104, 106, can be filled with a coolant, such a liquid/gel-type substance commonly found in freezer chilled cooling packs. The cooling pack 102 is thus freezable and re-freezable. These gel in the gel packs are primarily water-based and include a gel-forming substance, such as hydroxyethyl cellulose or a vinyl-coated silica gel. Other materials can be added to prevent bacterial growth. Advantageously, the substance in such gel packs can formulated to have a freezing point below that of water (32° F.) and therefore can enhance the cooling of the grinder head 202. The cooling pack 102 can have a variety of constructions. For example, the cooling pack 102 can be formed of plastic, metal, or a combination of plastic and metal.

Figure 11:
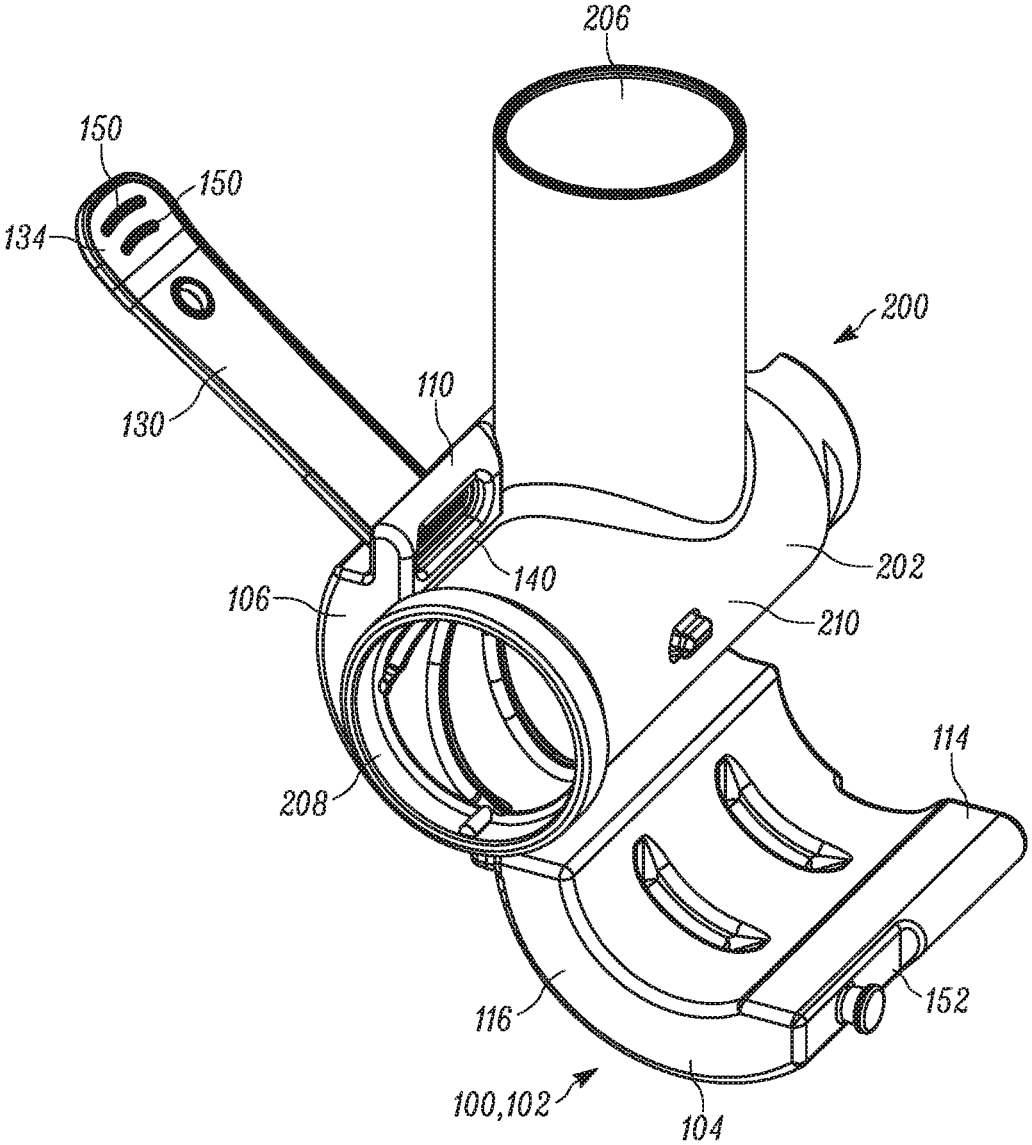
FIG. 11 is a perspective view illustrating the installation of the apparatus of FIG. 6 on a grinder head.
Figure 12:
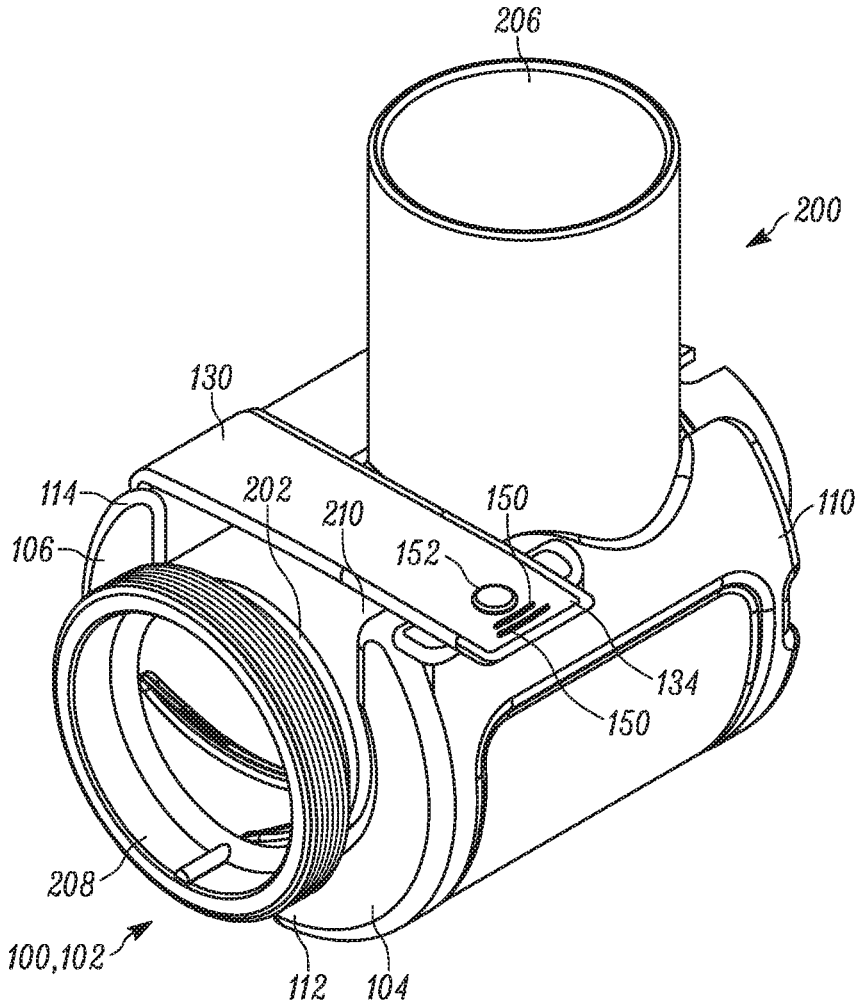
FIG. 12 is a top perspective view illustrating the apparatus installed on the grinder head.

To install the apparatus 100 on the grinder head 202, the apparatus is placed in an open condition as shown in FIG. 11. The first strap 120 maintains the connection between the lower ends 112, 116 of the cooling pack halves 104, 106 and permits relative movement between the halves so that they can be maneuvered to the position shown in FIG. 11. The upper ends 110, 114 of the cooling pack halves 104, 106 can then be brought together so that they extend around the grinder head 202 and the inner surfaces 108 of the cooling pack halves engage and mate with the outer surface 230 of the grinder head housing 210. At this point, the second end 134 of the second strap 130 can be connected to the first half 104 by placing the opening 150 over the tab 152 (see FIG. 12).

Advantageously, the removable cooling pack 102 allows for the use of multiple cooling packs in an interchangeable fashion. When the cooling packs 102 heat up during use and lose their effectiveness, they can be swapped with frozen standby packs, thus eliminating the need to halt the grinding process for a prolonged period. During use, the cooling pack 102 helps to maintain the grinder head 202 at a low temperature. For example, the coolant in the packs 102 can maintain the grinder head 202 at about 40° F. or less. The advantage of a coolant/gel-filled cooling pack 102 is that the gel can be formulated for cooling below 32° F. The elastomeric construction of the straps 120, 130 can urge the cooling pack 102 against the housing 210 to help ensure effective heat transfer, i.e., cooling, of the grinder head 202.

Figure 16:
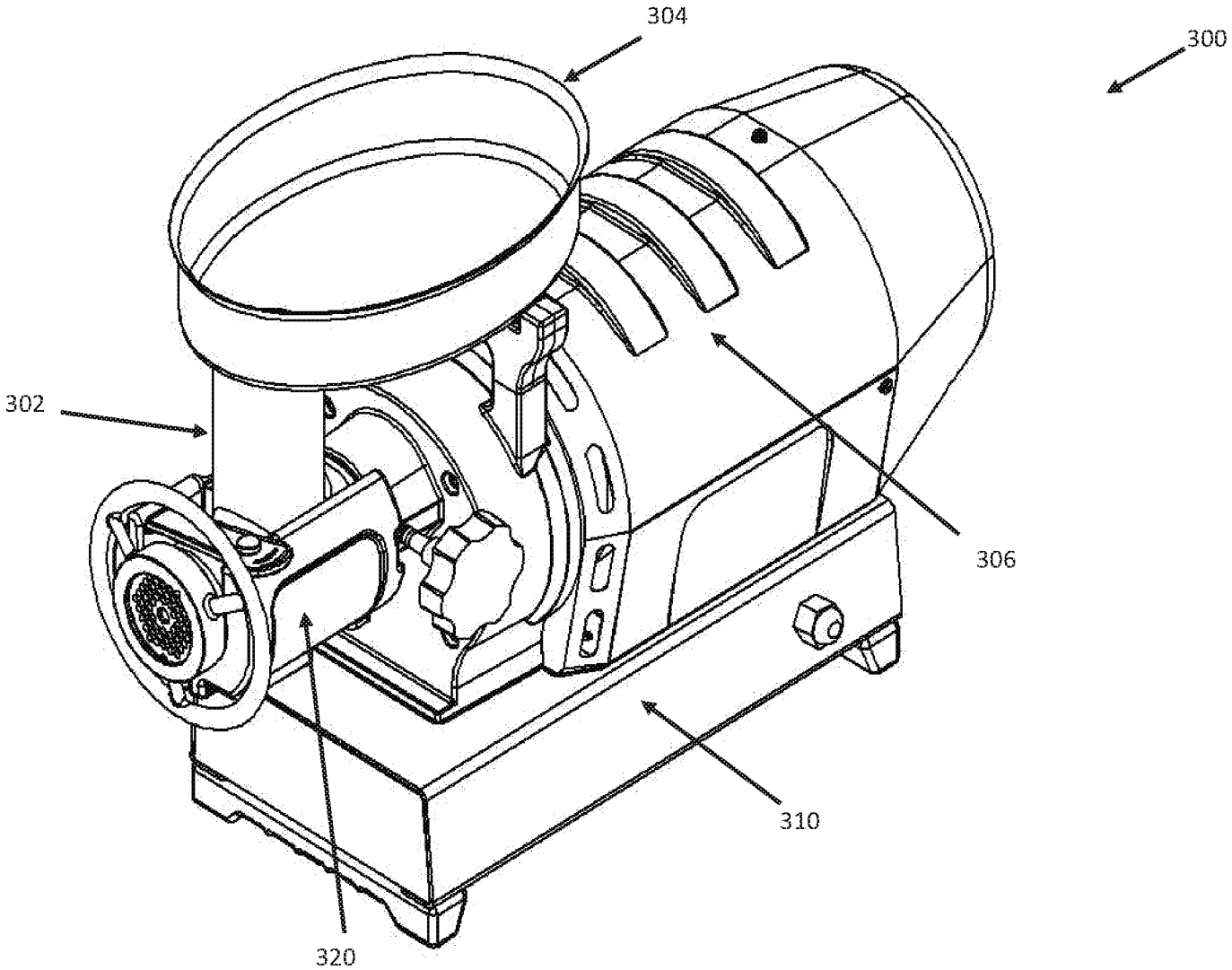
FIG. 16 is a perspective view of a meat grinder and the grinder head cooling pack depicting the new design grinder head cooler with heatsink.
Figure 17:
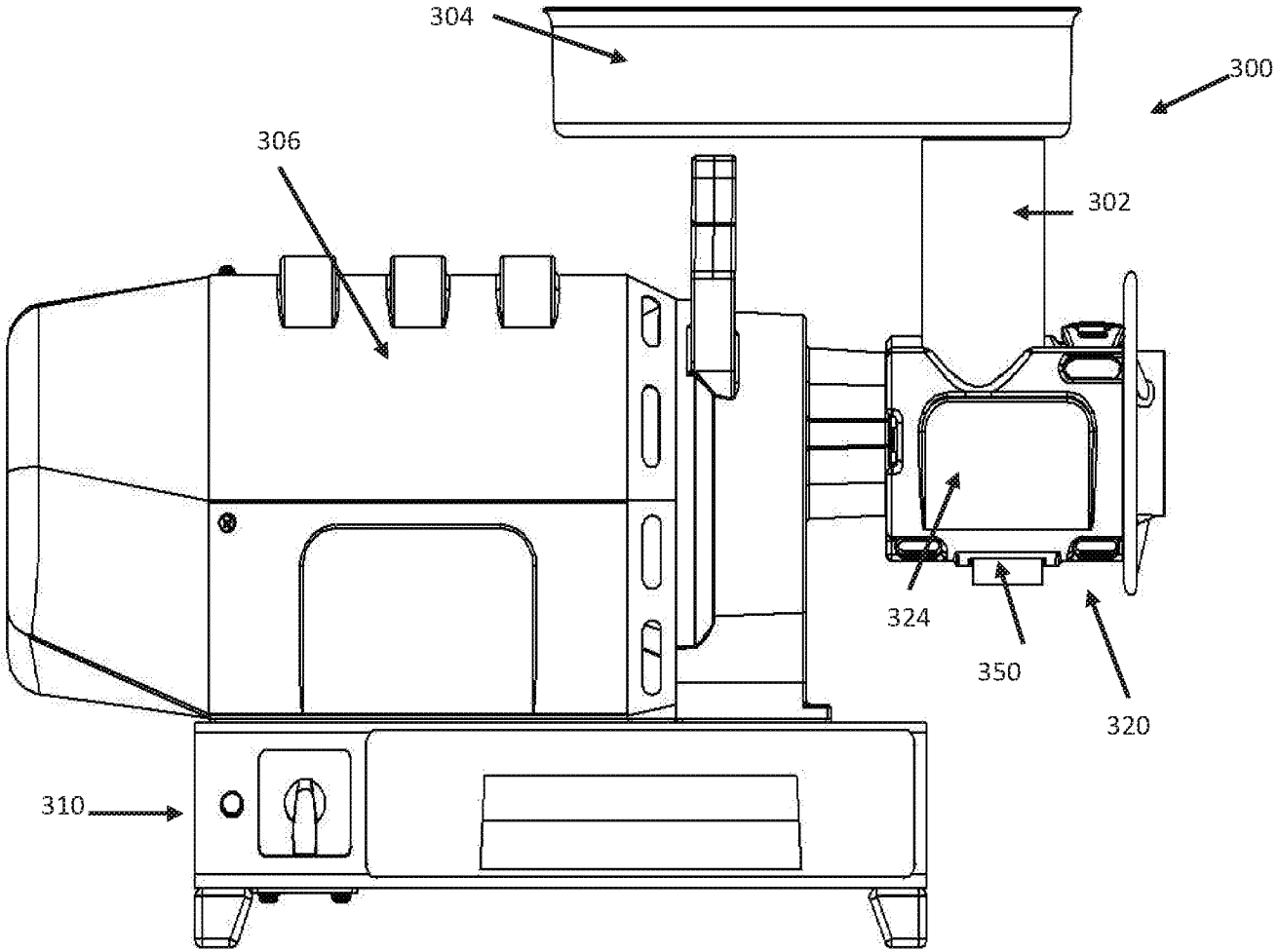
FIG. 17 is an overall meat grinder side view with the grinder cooler enclosure with heatsink.

Another example configuration is illustrated in FIGS. 16-30. The example configuration illustrated in FIGS. 16-30 is for purposes of illustration only and is not meant to limit the invention to this particular configuration. FIGS. 16 and 17 show a food grinder appliance 300. The food grinder appliance 300 includes a grinder head 302 for grinding the food, a meat tray 304 for temporary handling of the food before loading in to the grinder head 302, a power source in the form of an electric motor 306 for driving the grinder head 302 to grind the food, and a base support 310 for supporting the appliance.

A cooling pack assembly 320 is secured to the grinder head 302 and extends circumferentially around the grinder head. The cooling pack assembly 320 can be similar in some respects to the cooling pack 102 of FIGS. 6-15 and/or identical in some respects to the cooling pack 102 of FIGS. 6-15. For this reason, some aspects of the cooling pack 320 are either not described in detail or not at all. It is to be understood, however, that those details can be gleaned from the detailed description of corresponding aspects of the cooling pack 102 of the example configuration of FIGS. 6-15.

The cooling pack assembly 320 includes a left-half side 322 and a right half side 324 that attach circumferentially to the grinder head 12 to cool the grinder head during the grinding operation. To enhance the cooling effect, the cooling pack assembly 320 includes a heatsink 350. The heatsink 350 is supported at least partially by the cooling pack halves 322, 324 in contact with the grinder head 302.

Figure 18:
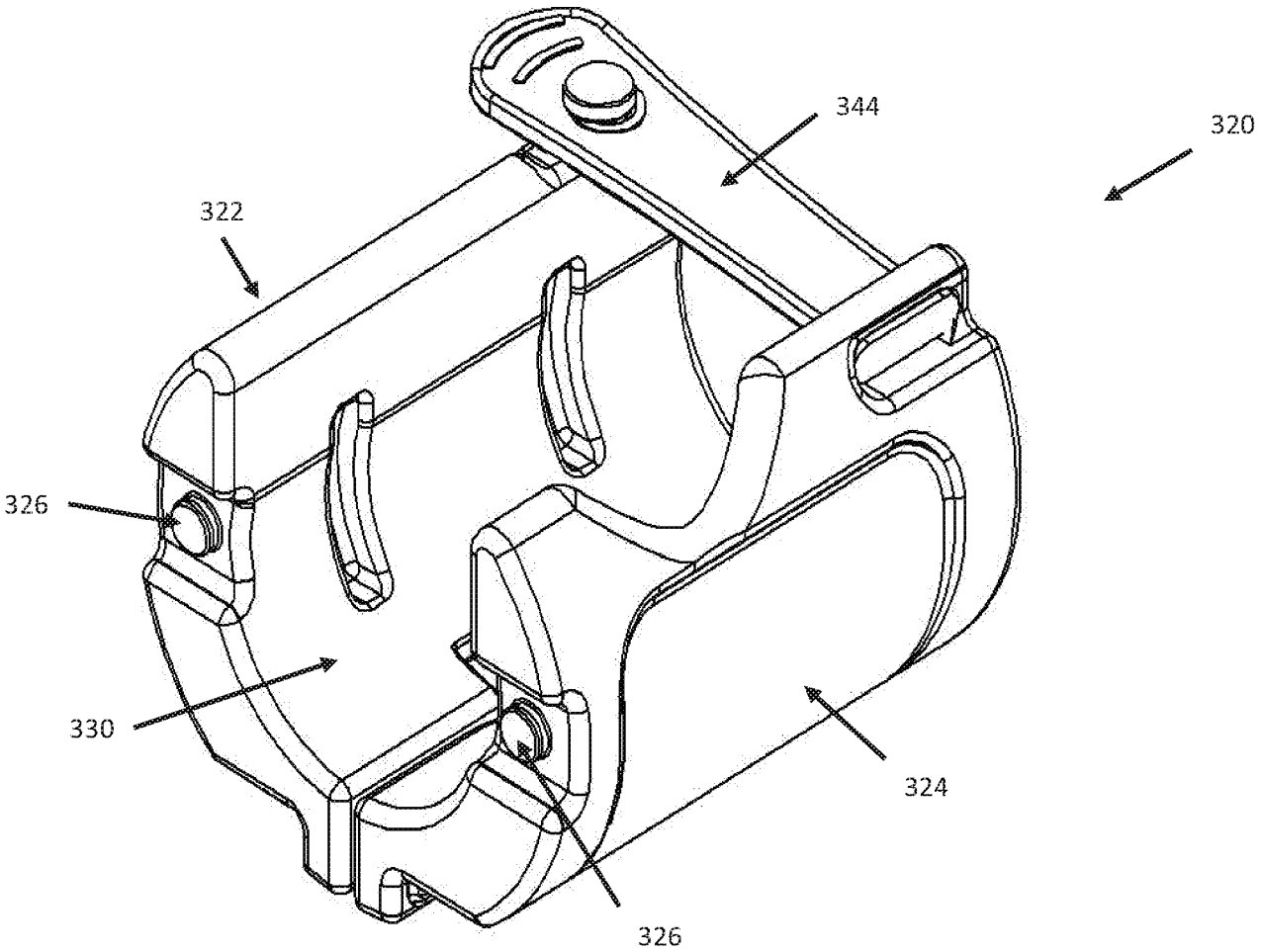
FIG. 18 is a perspective view of the cooling pack.
Figure 19:
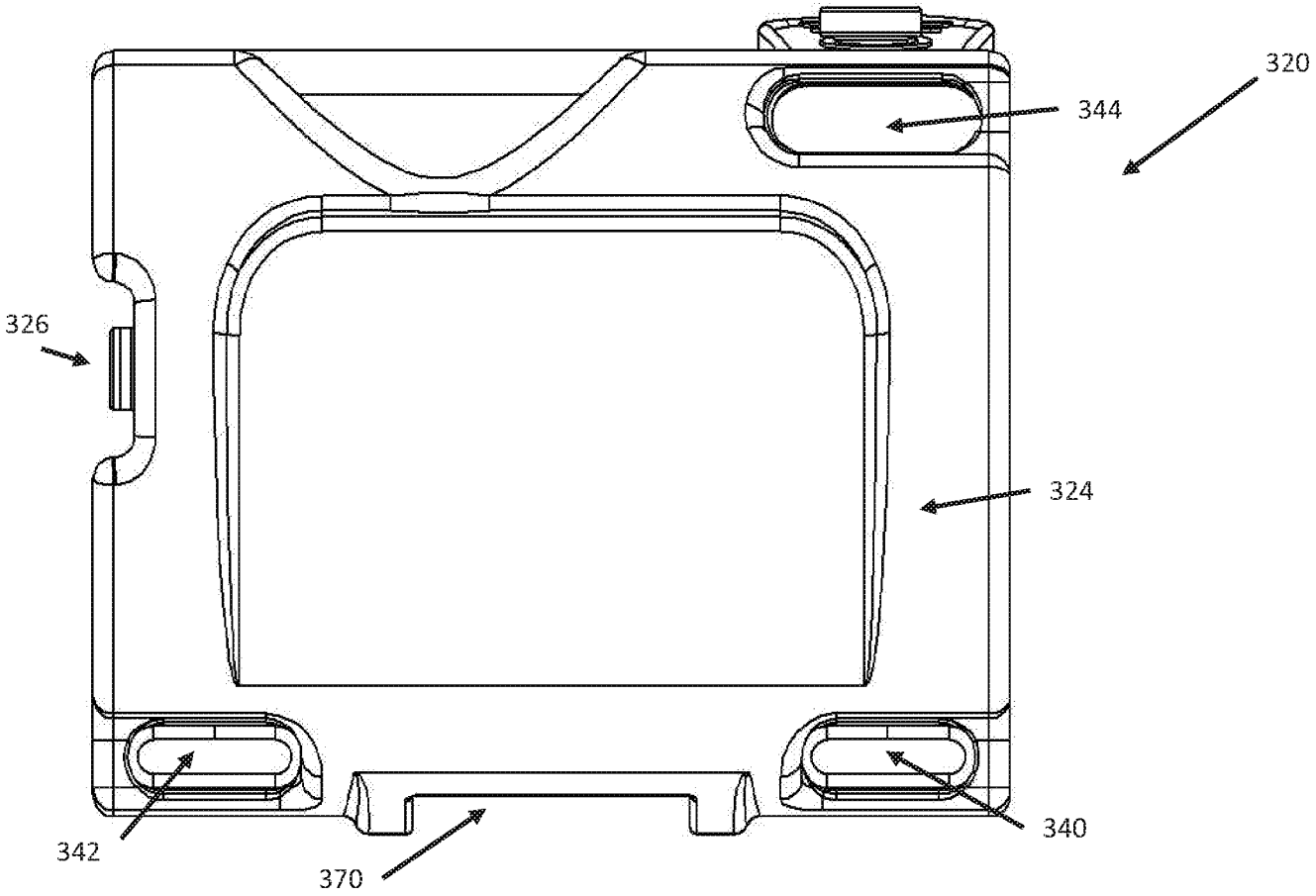
FIG. 19 is a side view of the cooling pack depicting one cooling pack half.

FIGS. 18-19 illustrate the left and right cooling pack halves 322, 324 prior to installation of the heatsink 350. The cooling pack halves 322, 324 retain a freezable and re-freezable fluidic material in respective internal cavities of the pack halves. The freezable and re-freezable fluidic material is retained within the cavities of the cooling pack halves 322, 324 by sealing caps 326 that seal the filling ports to the cavities. Together, the cooling pack halves 322, 324 have a generally C-shaped configuration with a curved inner surface 330 having a configuration and circumference that matches a corresponding surface of the grinder head 302.

The cooling pack halves 322, 324 are connected together by three connection straps: a front lower connection strap 340, a rear lower connection strap and 342, and a top front connection strap 344. The cooling pack assembly 320 when attached to the grinder head 302 circumferentially wraps around and directly contacts the corresponding surface of the grinder head and wraps more than 180 degrees around its circumference. When assembled together, the cooling pack halves 322, 324 form a recessed heatsink receiving portion 370 for receiving and retaining the heatsink 350 in the cooling pack assembly 320.

Figure 20:
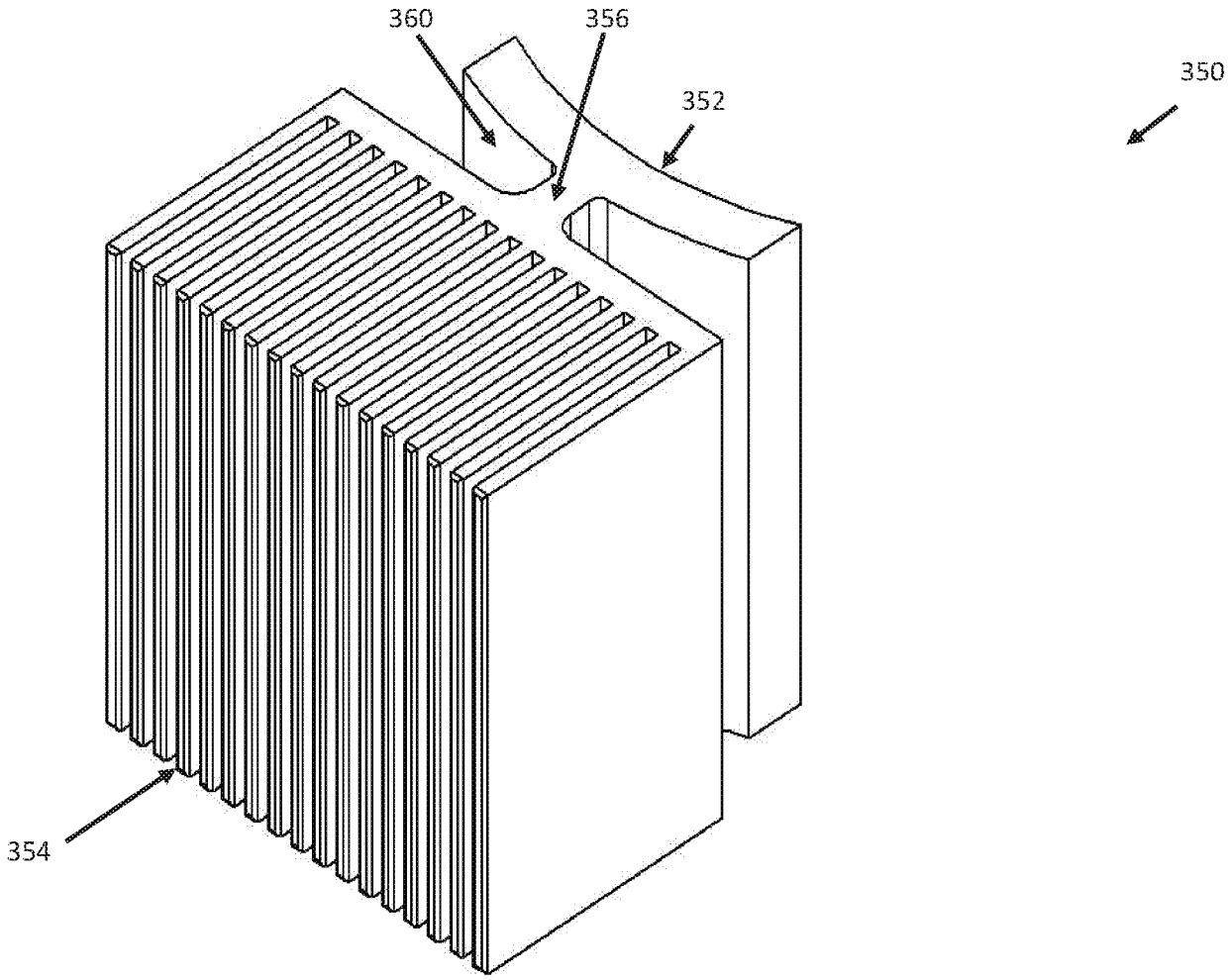
FIG. 20 is a perspective view of the heatsink.
Figure 21:
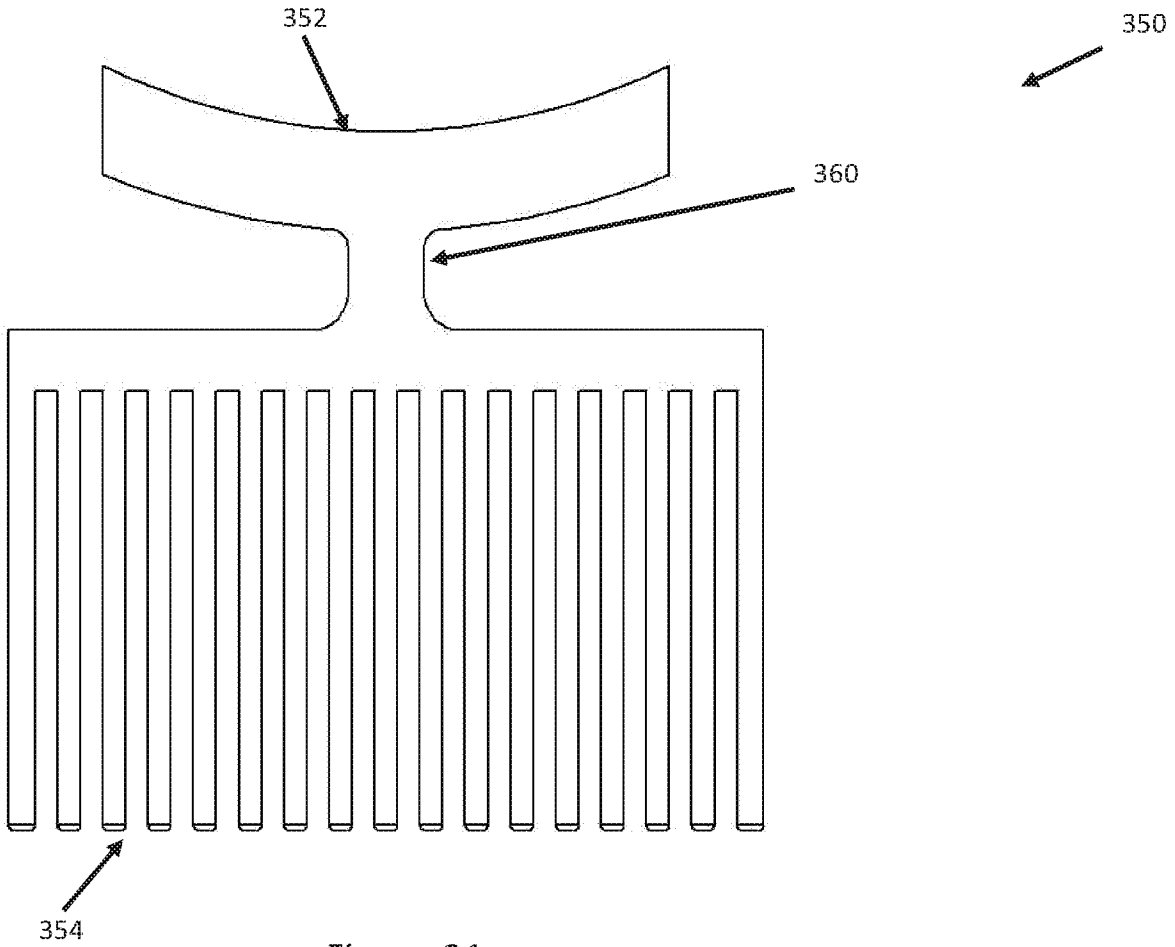
FIG. 21 is a front view of the heatsink.

With reference now to FIGS. 20 and 21, the heatsink 350 made of a thermally conductive material, such as a metal or metal alloy, e.g., aluminum. The heatsink 350 has an upper heatsink surface 352 that has a curved configuration with a radius to match the circumference of the outer surface of the grinder head 302. A block of heatsink fins 354 is spaced from the upper heatsink surface by a stem portion 356 so as to create opposing spaces defining a heatsink throat 360 for receiving and engaging the cooling pack halves 322, 324 in the area of the heatsink receiving portion 370 in order to connect the heatsink 350 to the cooling pack assembly 320. When assembled, the throat 360 allows the two cooling pack halves 322, 324 to retain the heatsink 350 by pinching stem portion 356 between the halves.

When the cooling pack assembly 320 is secured to the grinder head 302, the upper heatsink surface 352 mates with and engages the corresponding surface of the grinder head. The upper heatsink surface 352 is configured such that its entire surface, or substantially its entire surface, touches and engages the surface of the grinder head 302. This complete and direct engagement provides a direct thermal connection and provides a thermally conductive conduit path to the heatsink fins 354. In use, the heatsink 350 will draw heat from the grinder head 302 through the heatsink upper surface 352, which will be conducted to the heatsink fins 354, which dissipate the heat to the ambient air.

Figure 22:
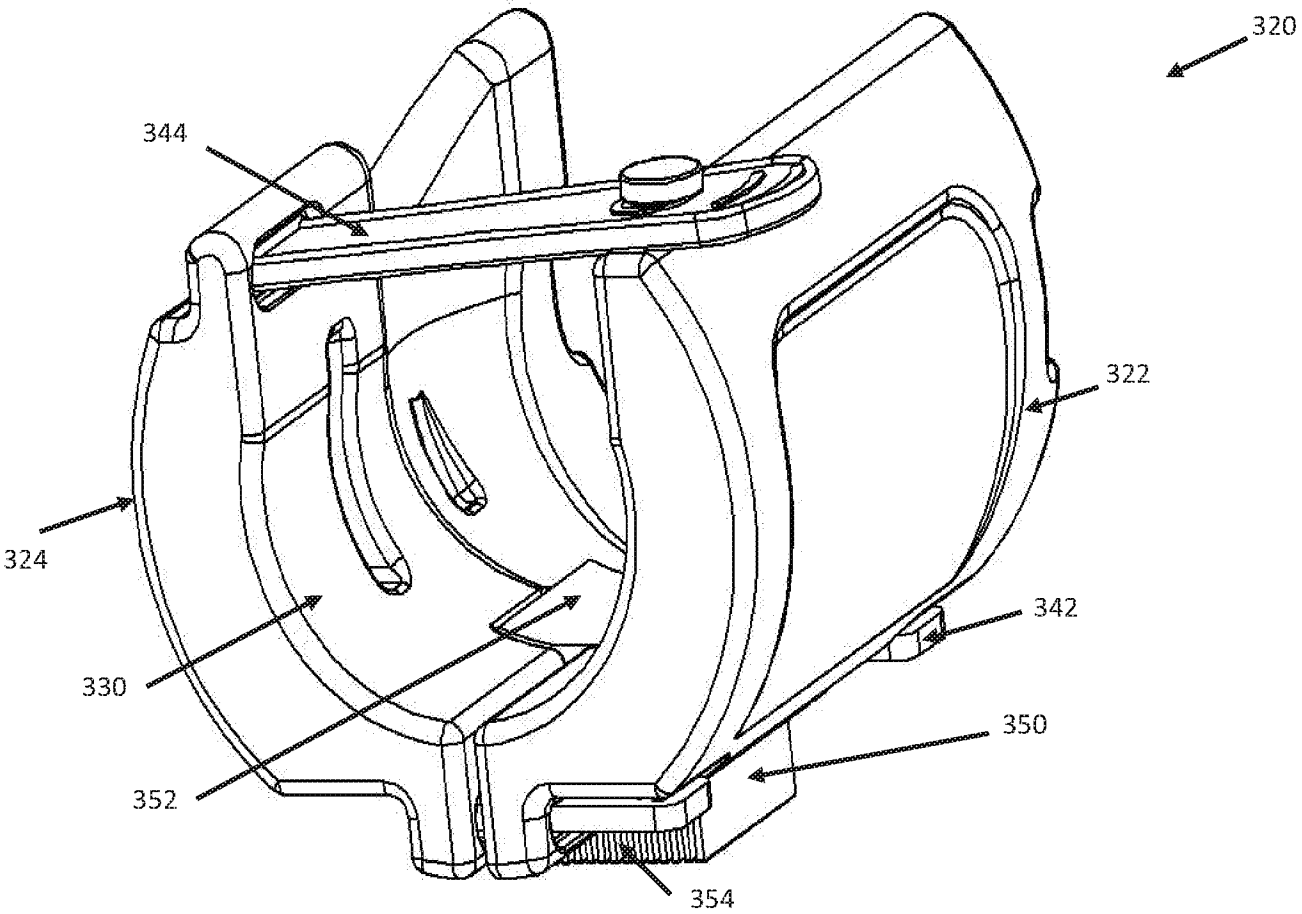
FIG. 22 is a perspective view of the grinder head cooling pack with heatsink.

Referring now to FIGS. 22-27, show multiple construction views of the cooling pack assembly 320. FIG. 22 is a perspective view illustrating the cooling pack halves 322, 324 with the heatsink 350 retained between. In this figure, it can be seen that the heatsink upper surface 352 is contiguous with the inner surface 330 defined by the cooling pack halves 322, 324. These surfaces match the outer circumference surface of the grinder head 302 thereby providing direct thermal contact for cooling the grinder head 302. The heatsink fins 354 protrude from the cooling pack assembly 320 and are exposed to ambient air. The straps 340, 342, 344 to retain the cooling pack assembly 320 on the grinder head 302 and thereby retain the heatsink 350 in engagement with the grinder head 302.

Figure 23:
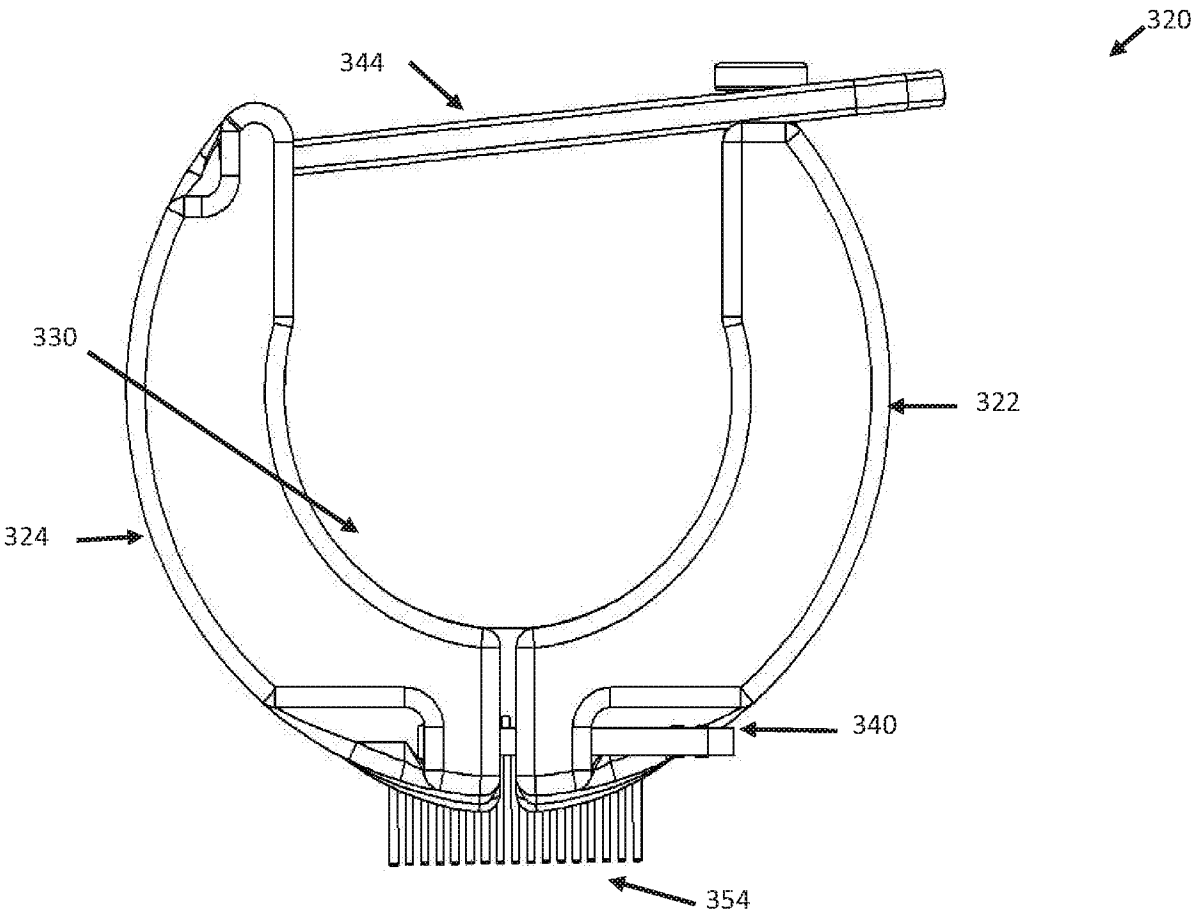
FIG. 23 is a front view of the grinder head cooling pack with heatsink.
Figure 24:
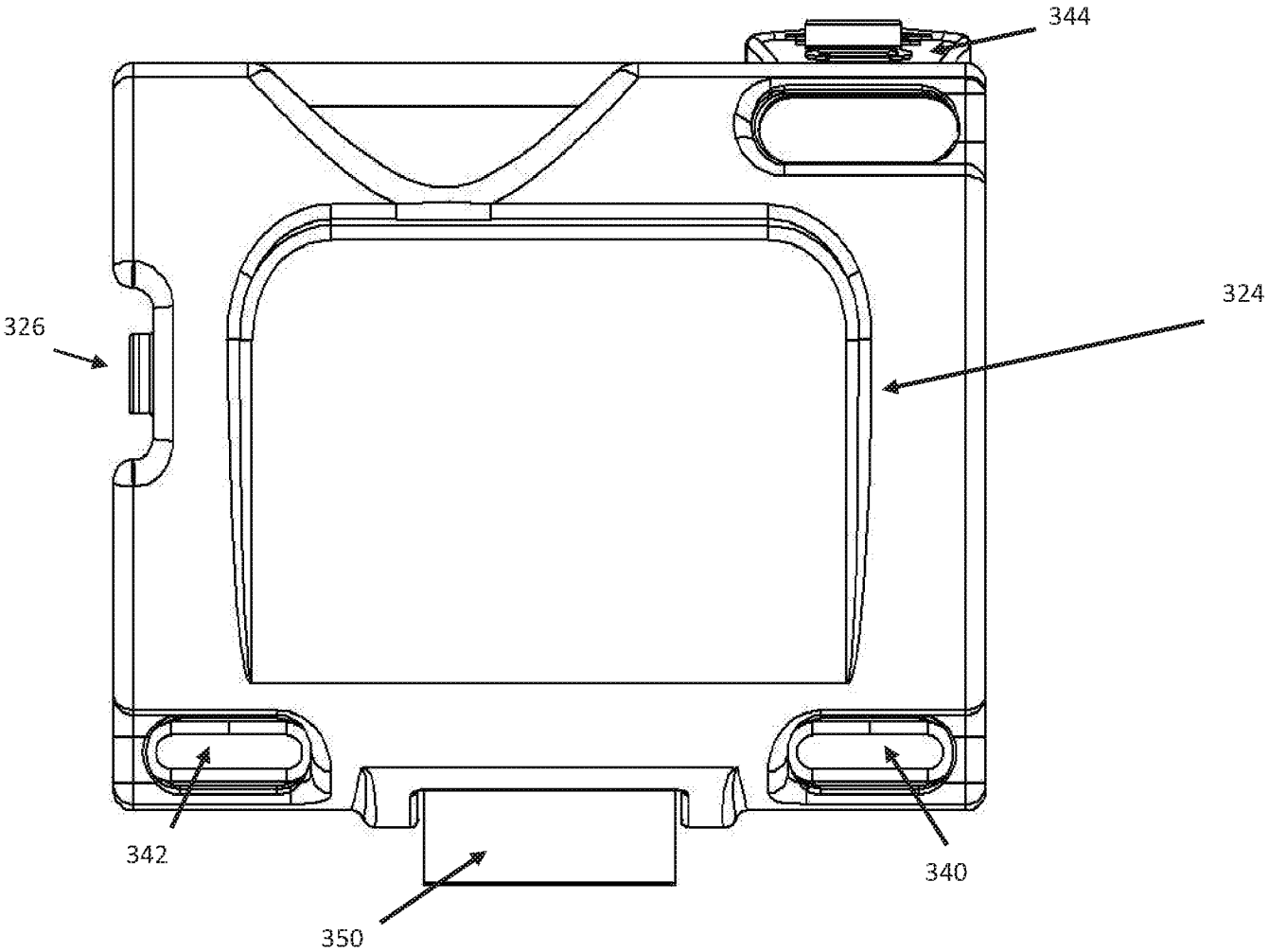
FIG. 24 is a side view of the cooling pack depicting one cooling pack half and the heatsink.
Figure 25:
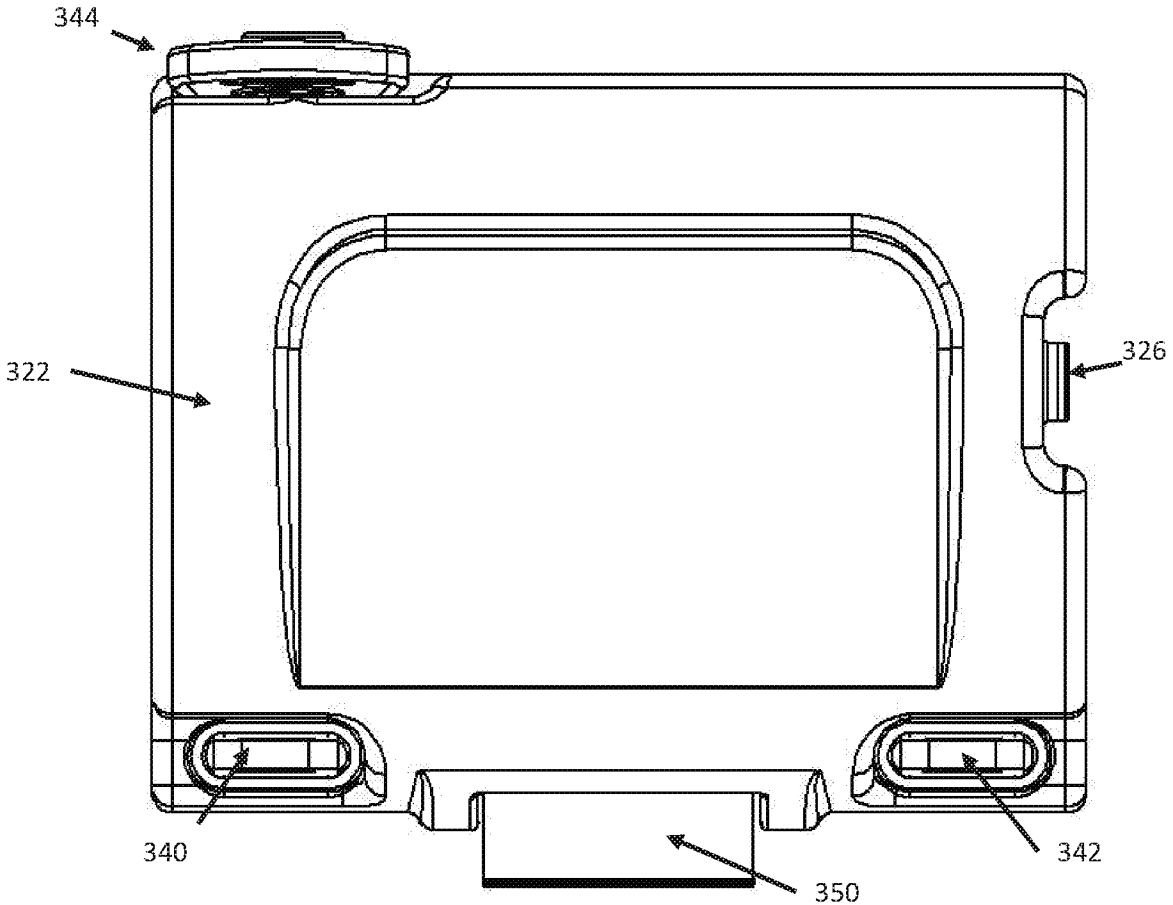
FIG. 25 is an opposite side view of the cooling pack depicting one cooling pack half and the heatsink.

FIG. 23 is a front construction view of the cooling pack assembly 320 and additionally shows the front lower connection strap 340. FIG. 24 is the right side view of the cooling pack assembly 320 and additionally shows the cooling pack sealing cap 326 that retains the freezable and re-freezable fluidic material. FIG. 25 is the left construction view of the cooling pack assembly 320.

Figure 26:
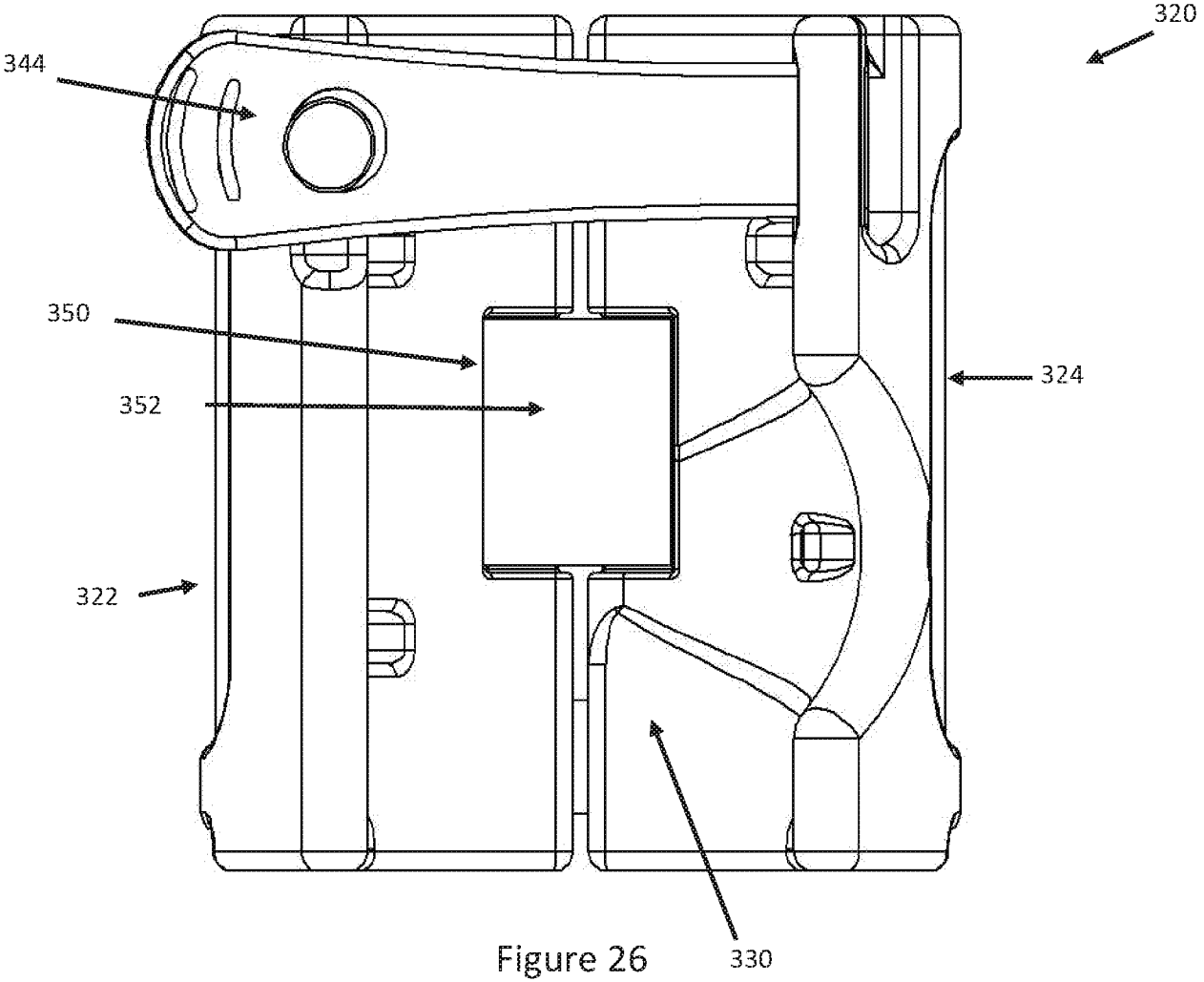
FIG. 26 is a top view of the grinder head cooling pack with heatsink.
Figure 27:
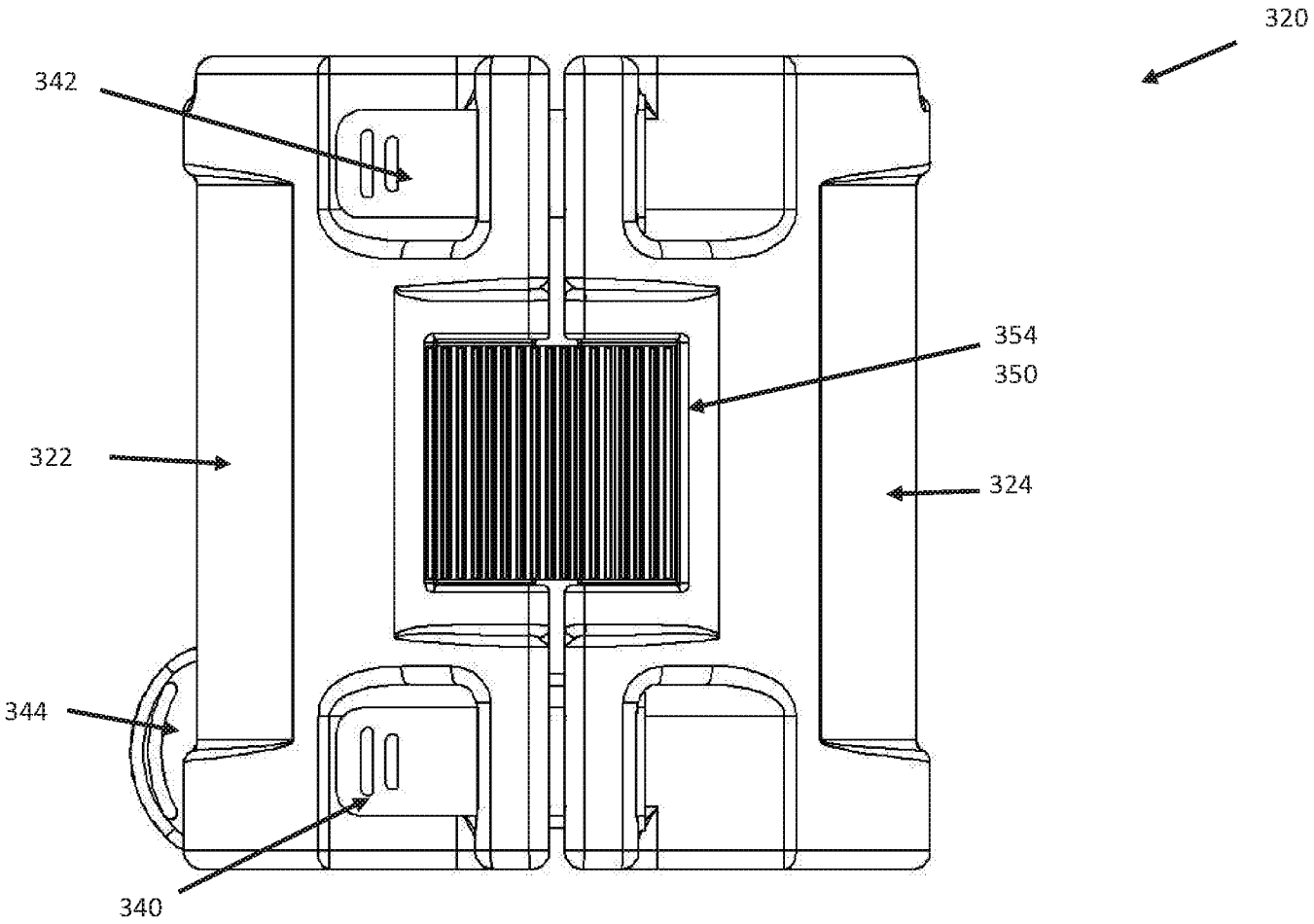
FIG. 27 is a bottom view of the grinder head cooling pack with heatsink.

FIG. 26 is the top construction view of the cooling pack assembly 320. In this view is shown the circumferential contact surfaces of the cooling pack 330 and the radiused heatsink upper surface 352. FIG. 26 is the bottom construction view of the cooling pack assembly 320. This view shows the heatsink 350 lower surface with the plurality of heatsink fins 354 to dissipate heat to ambient air.

Figure 28:
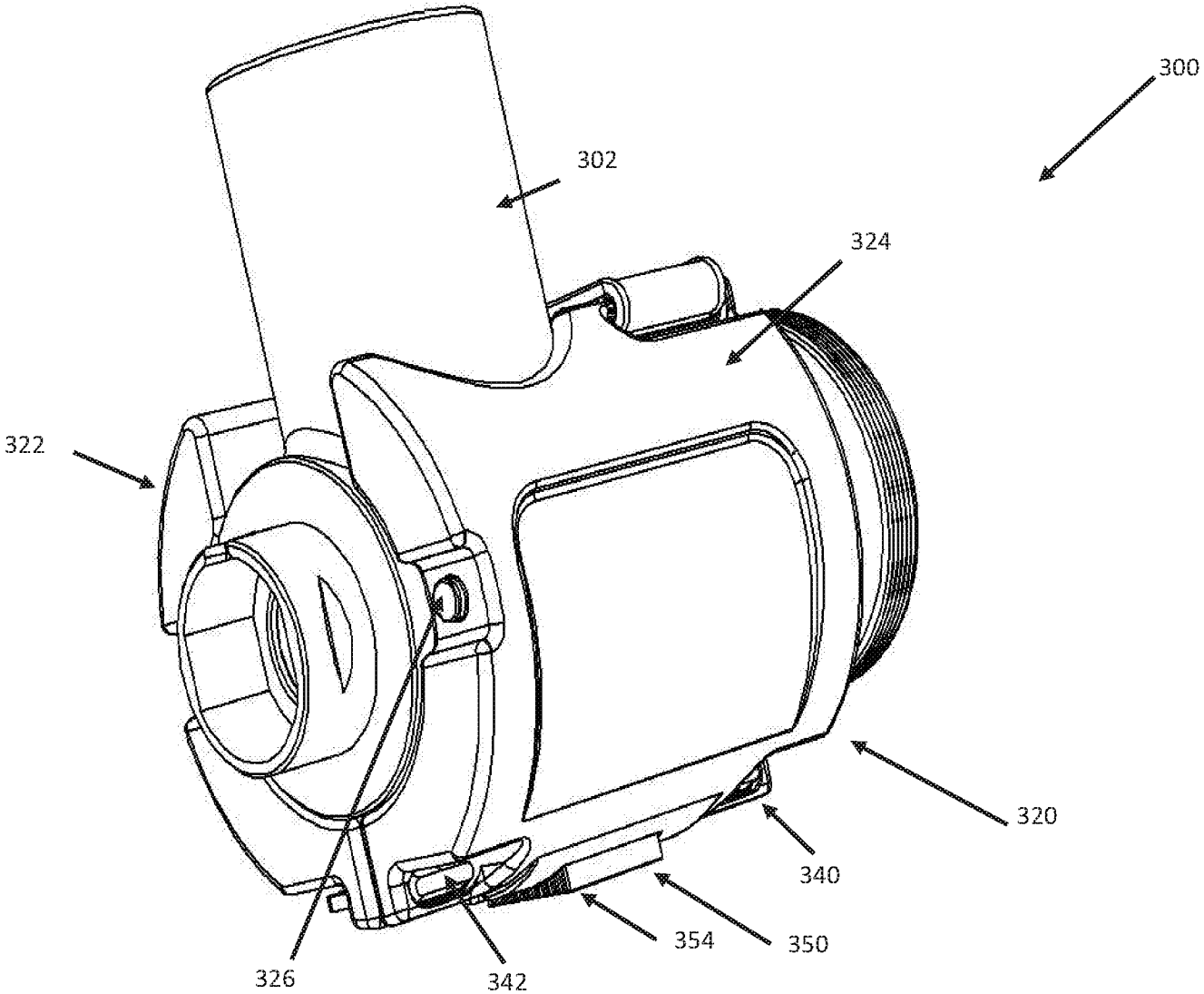
FIG. 28 is a perspective view of the grinder head and the attached grinder head cooling pack with heatsink.
Figure 29:
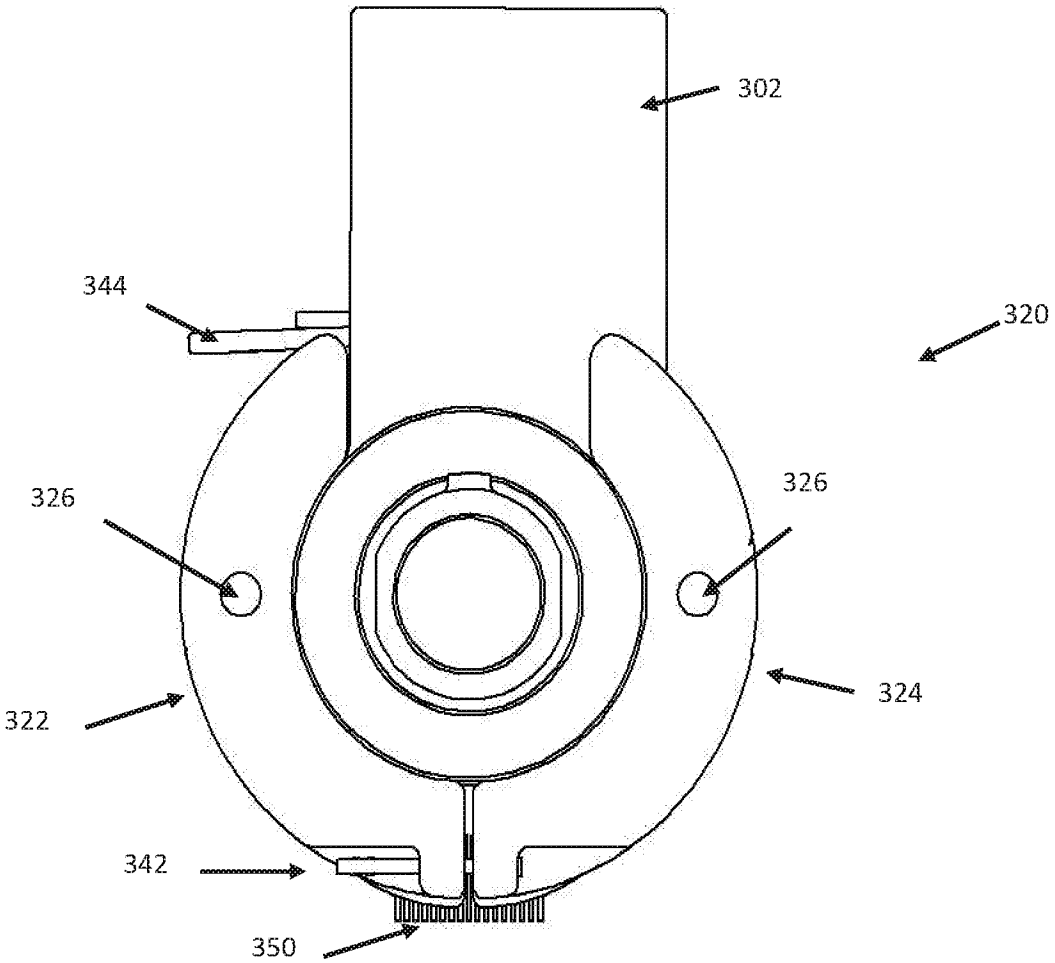
FIG. 29 is a front view of the grinder head and the attached grinder head cooling pack with heatsink.
Figure 30:
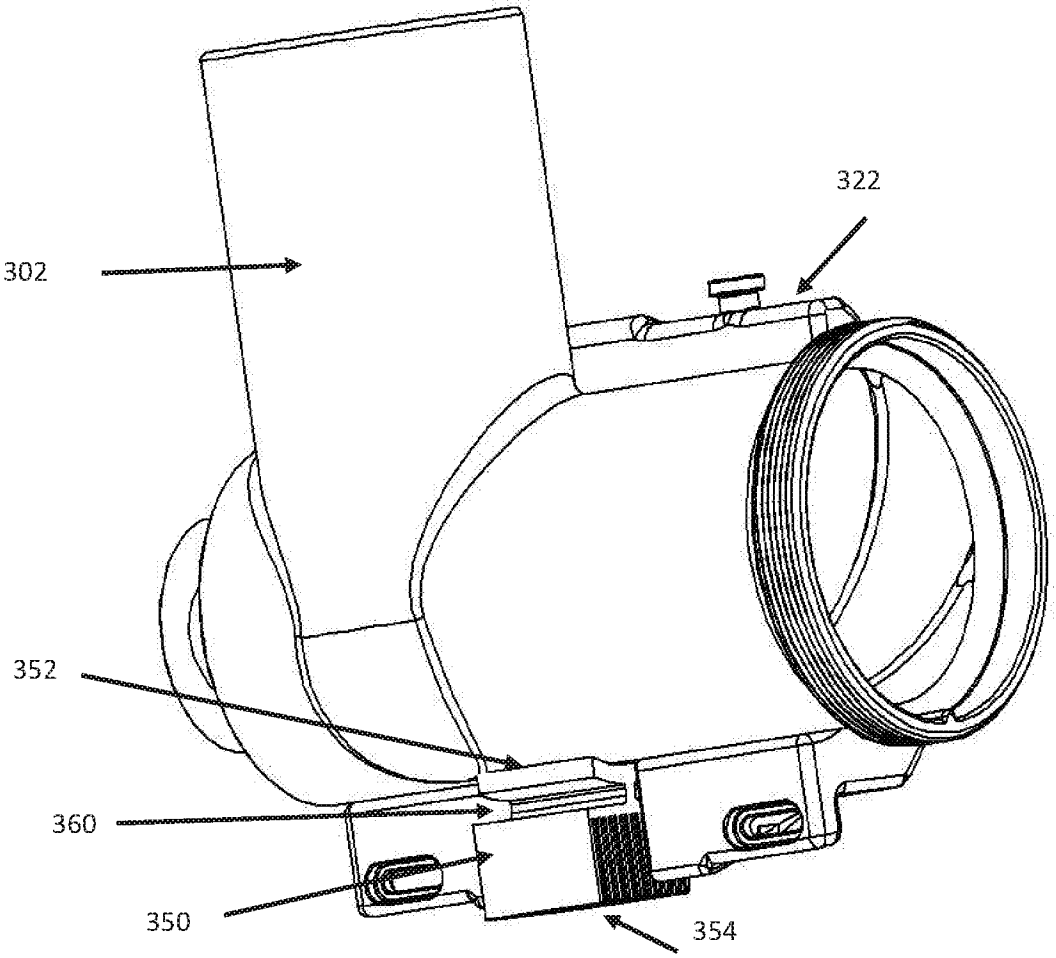
FIG. 30 is a perspective view of the grinder head with one cooling pack half removed and the opposite cooling pack half with heatsink.

Now referencing FIG. 28-30 shown are multiple assembly construction views of the cooling head 302 circumferentially encased by the cooling pack assembly 320. FIG. 28 shows the cooling pack assembly 320 on the grinder head 302. The cooling pack assembly 320 circumferentially encases the grinder head 302 with an attachment contact area exceeding 180 degrees. The heatsink 350, specifically the heatsink fins 354, is/are shown protruding from the bottom of the cooling pack assembly 320 to ambient air. Connection straps 340, 342, 344 attach the cooling pack halves 322, 324 to the grinder head 12. FIG. 29 is a front construction view of the cooling pack assembly 320 circumferentially attached to the grinder head 302. In FIG. 30, the left cooling pack half 324 is removed from the drawing to provide a view of the direct thermal contact interface of the heatsink upper surface 352 and the cooling pack circumference surface 330 to the outside surface of the grinder head 302.

While aspects of the present invention have been particularly shown and described with reference to the preferred embodiment above, it will be understood by those of ordinary skill in the art that various additional embodiments may be contemplated without departing from the spirit and scope of the present invention. For example, the tab/slot configuration used to connect the cooling pack to the housing could be replaced with an alternative connection without departing from the spirit and scope of the invention. Other aspects, objects, and advantages of the present invention can be obtained from a study of the drawings, the disclosure, and the appended claims.

Having described the invention, we claim:

1. An apparatus for cooling a food processing grinder head comprising:

at least one cooling pack that attaches to the outer surface of the food processing grinder head; and a heatsink retained by the at least one cooling pack in direct contact on an outer surface of the food processing grinder head, the heatsink being configured to thermally conduct heat away from the food processing grinder head to a plurality of fins that disperses the conducted heat to ambient air.

2. The apparatus recited in claim 1 wherein the heatsink is comprised of a thermally conductive material with a surface having a curved profile configured to engage and mate with an outer surface of the food processing grinder head against which the heatsink is positioned.

3. The apparatus recited in claim 1 wherein the at least one cooling pack extends greater than 180 degrees circumferentially around the outer surface the food processing grinder head.

4. The apparatus recited in claim 1 wherein the at least one cooling pack comprises a recessed cavity that receives and retains the heatsink.

5. The apparatus recited in claim 4 wherein the heatsink comprises an upper heatsink surface and a block of heatsink fins spaced from the upper heatsink surface by a stem portion so as to create opposing spaces defining a heatsink throat portion, the opposing spaces receiving portions of the at least one cooling pack on opposing sides of the recessed cavity, the portions of the at least one cooling pack on opposing sides of the recessed cavity clamping onto the stem to help retain the heatsink on the at least one cooling pack.

6. The apparatus recited in claim 1 wherein the at least one cooling pack comprises a sealed internal cavity filled with a freezable and re-freezable fluidic substance disposed therein.

7. The apparatus recited in claim 1 wherein the at least one cooling pack comprises a first cooling pack half and a second cooling pack half with that are connectable to each other, the cooling pack halves being configured to receive and retain the heatsink when connected to each other.

8. The apparatus recited in claim 7, further comprising straps for connecting the first and second cooling pack halves.

9. A food processing grinder head cooling apparatus comprising a freezable and re-freezable cooling pack and a heatsink supported by the freezable and re-freezable cooling pack, wherein the cooling pack is configured to be connected to an outer surface of the food processing grinder head with surfaces of the freezable and re-freezable cooling pack and the heatsink engaging the outer surface.

10. The food processing grinder head cooling apparatus recited in claim 9, wherein the cooling pack comprises first and second cooling pack halves that are connectable to each other and to the heatsink.

* * * * *